United States Patent [19]

Burgit et al.

[11] Patent Number: 4,633,570

[45] Date of Patent: Jan. 6, 1987

[54] APPARATUS FOR ASSEMBLING AN ELECTRICAL CONNECTOR TO A CABLE

[75] Inventors: Richard A. Burgit, Middletown; Newton G. Davis, Harrisburg; Josita M. Goyert, Elizabethtown; Keith Johnson, Jr., Manheim; Robert A. Long; Joseph F. Stachura, both of Harrisburg, all of Pa.

[73] Assignee: AMP Incorporated, Harrisburg, Pa.

[21] Appl. No.: 748,097

[22] Filed: Jun. 24, 1985

[51] Int. Cl.[4] ..... H01R 43/04

[52] U.S. Cl. ..... 29/564.4; 29/33 M; 29/749

[58] Field of Search ..... 29/564.1, 564.2, 564.3, 29/564.4, 564.7, 564.8, 566.1, 749, 751, 753, 33 M, 564.6, 750, 857, 866, 873, 715, 716; 81/9.51

[56] References Cited

U.S. PATENT DOCUMENTS

| | | | |
|---|---|---|---|
| 3,768,143 | 10/1973 | Holmes, Jr. | 81/9.51 X |
| 3,939,552 | 2/1976 | Hart et al. | 81/9.51 X |
| 4,015,497 | 4/1977 | Burgess | 81/9.51 X |
| 4,199,854 | 4/1980 | Bihing et al. | 81/9.51 X |
| 4,249,433 | 2/1981 | Hara | 81/9.51 |
| 4,344,225 | 8/1982 | Johnson, Jr. et al. | 29/564.1 X |
| 4,345,362 | 8/1982 | de Givny | 81/9.51 X |
| 4,377,898 | 3/1983 | Hara | 29/564.1 |
| 4,516,309 | 5/1985 | Clark | 29/564.4 |
| 4,581,796 | 4/1986 | Fukuda et al. | 29/564.4 X |

*Primary Examiner*—Gil Weidenfeld
*Assistant Examiner*—Glenn L. Webb
*Attorney, Agent, or Firm*—Thomas G. Terrell

[57] ABSTRACT

Apparatus for assembling electrical connectors to multi-conductor insulated cables, comprises a table which is movable along a first path past a fixed cable clamp, the table carrying a cable stripper assembly and a connector applicator assembly, which are independently movable on the table along paths perpendicular to the second path. The table and the two assemblies are arranged to be moved cyclically so that first a cable held by the cable clamp has the insulation stripped from an end portion thereof by the stripper assembly, whereafter a connector previously fed to the applicator is applied to the end of the cable. The stripper assembly may have cable shield slitting means and the applicator may have cable shield folding back means.

10 Claims, 33 Drawing Figures

70

64
86
66
68
54
62
66
56
28
53
58

APPARATUS FOR ASSEMBLING AN ELECTRICAL CONNECTOR TO A CABLE

This invention relates to apparatus for assembling an electrical connector to an end portion of a multiconductor electrical cable having a cable sheath.

There is described in US-A-4,516,309, apparatus of this kind, comprising a table which is movable in opposite directions along two mutually perpendicular paths relative to a cable clamp assembly, the table carrying a cable stripper assembly and a connector applicator assembly with means for feeding connectors to the applicator assembly. The table is arranged to be moved cyclically in such a way that first a cable held by the cable clamp assembly has the sheath stripped from an end portion thereof by the cable stripper assembly, whereafter the leading connector of the strip is held in the applicator assembly and is moved onto the stripped end of the cable and is applied thereto by the applicator assembly.

Since the stripper and the applicator assemblies are both fixed to the table, the distance that these assemblies are moved towards and away from the clamp assembly is determined by the distance of travel of the table towards and away from the clamp assembly. Thus, the movement of the stripper assembly and the applicator assembly relative to the clamping assembly cannot be individually controlled and especially the depth of insertion of the stripped cable end into the connector. Also, if for example, other operations are to be carried out on the stripped cable end, for example, if the cable has a shield which is to be folded back against the cable sheath so that it does not enter the connector, the travel of means for effecting this operation, which may be provided on both the stripper and the applicator assemblies needs to be closely controlled.

The invention is intended to provide apparatus for assembling an electrical connector to an end of a multiconductor electrical cable having a cable sheath, which apparatus is susceptible to more accurate control than the apparatus referred to above and which is also more versatile in that it can be provided with means for processing a metal shield made, for example, of metal foil, when such is present between the cable jacket and the cable sheath.

To this end, the table is arranged to be translated only along a first path extending past the cable clamp assembly, means being provided for translating the stripper and applicator assemblies in two opposite directions and independently of one another, along respective second paths on the table, which paths are perpendicular to the first path, drive means for said assemblies and the connector feeding means being so controlled, by means of a control unit, that the end portion of a cable held by the clamp assembly is stripped of the sheath by the stripper assembly, a connector fed to the applicator assembly by the feeding means is moved onto the stripped end portion of the cable and the applicator assembly is actuated to apply the connector fed thereto to the stripped end portion of the cable.

Where the cable is provided with a metal shield surrounding the cable conductors and beneath the cable sheath, the stripper assembly may be provided with a pair of rotary cutting rolls for slitting opposite sides of the shield when the sheath has been stripped from the cable end, to divide the shield into a pair of flaps at the cable end. The flaps may be opened to a predetermined extent, by means of a blower device on the table, and the flaps may be folded back against the cable sheath by means of the applicator assembly, for example, by means of a pair of brushes, preferably wire brushes, which are movable under the action of the control unit between a closed shield folding back position and an open position to allow the cable end subsequently to be passed between the brushes into the connector that has been fed to the applicator assembly.

A tool for opening out the metal shield of a shielded cable, by means of a blower device and for subsequently folding the shield back against the sheath of the cable is described in US-A-3,621,560 but the cable shield is not, however, slit prior to these operations and the folding back operation is not performed by means of brushes. There is described in US-A-3,316,781 means for slitting the insulation of a cable by the use of rotary cutting rolls.

The clamp assembly preferably comprises a cable clamp which can be moved between a partially open position to allow the cable end portion to be inserted through the clamp, a closed position to grip the cable, and a fully open position to allow ejecting means of the clamp assembly to eject the cable from the clamp after the connector has been applied to the stripped cable end portion.

The movements of the parts mentioned above, are coordinated by means of the control unit and are preferably closely monitored by means of sensors. These sensors may be arranged to immobilize the apparatus in the case of malfunction and preferably also to cause the control unit to dislay an indication of the fault.

For a better understanding of the invention and to show how it may be carried into effect, referenced will now be made by way of example to the accompanying drawings in which.

Figure 1:
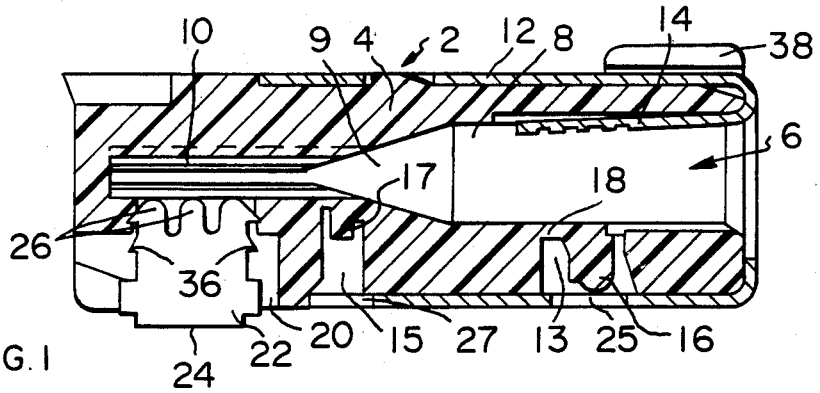
FIG. 1 is a longitudinal sectional view of an electrical connector for terminating a shielded, multi-conductor, flat, electrical cable.

As shown in FIG. 1, a multi-way electrical connector 2 for terminating a shielded, multi-conductor flat cable 28 (FIGS. 2, 3 and 3A), comprises an insulating housing 4, having an internal cavity 6, comprising an enlarged cable receiving portion 8 which merges, by way of a tapered portion 9 of the cavity 6, with a conductor receiving portion 10 of the cavity 6, which is of substantially smaller height than the portion 8. Extending about the housing 4, is a metal shield 12 having a reentrant portion 14 bent back within the cavity 6 along one wall thereof. The housing 4 is formed with a transverse, elongate opening 13, in which is an insulation crimp member 16 which is connected to the remainder of the housing 4 by a narrow neck 18 and which forms part of the wall of the portion 8 of the cavity 6. A second transverse elongate opening 15 in the housing 4, opposite to the cavity portion 9 has a base formed with a conductor gripping portion 17. An opening 20 in the housing 4, communicating with the portion 10 of the cavity i6, receives a row of electrical contacts 22 each having a contact surface 24 projecting slightly externally of the housing 4. Each contact 22 has insulation piercing prongs 26 facing inwardly of the portion 10, and is supported in the opening 20 by means of barbs 26 which bite into the walls of the opening 20. The shield 12 is formed with slots 25 and 27 allowing access to the openings 13 and 15, respectively, and does not cover the opening 20.

Figure 3:
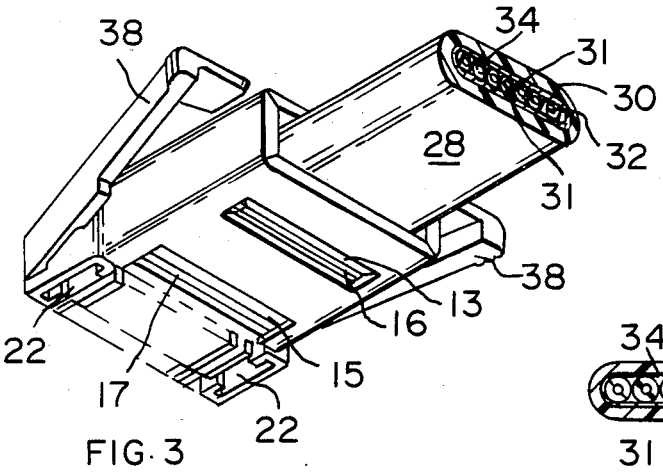
FIG. 3 is a perspective view showing the connector with the cable terminated thereto.
Figure 3A:
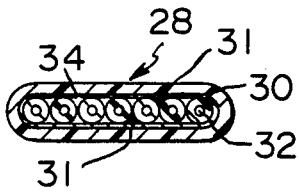
FIG. 3A is an end view of the cable.
Figure 4:
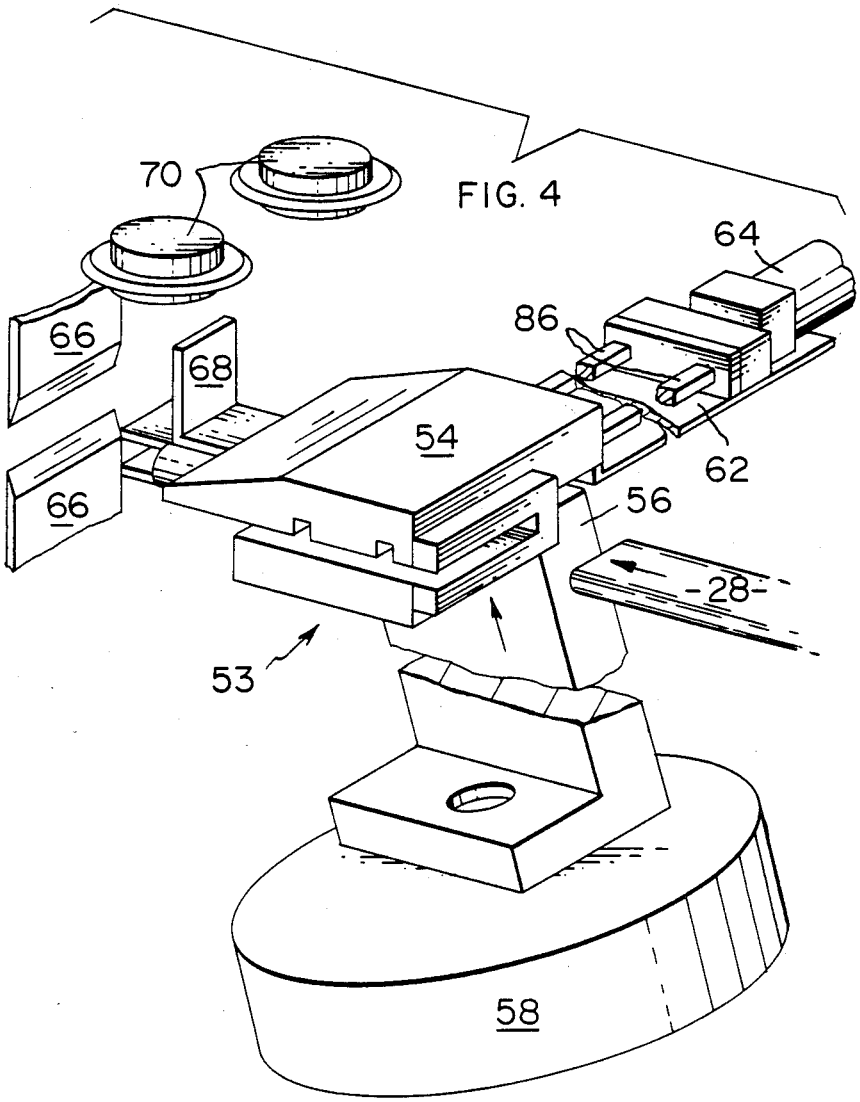
FIGS. 4 to 13 are fragmentary, diagrammatic, perspective, action views illustrating the operation of apparatus for terminating the cable to the connector.

The cable 28 comprises as best seen in FIG. 3A, an insulating sheath 30 surrounding a row of juxtaposed insulated conductors 32 on each side of which is a drain wire 31. A shield 34 beneath the sheath 30, made of flat, electrically conductive metal foil, surrounds the row of insulated conductors 32 and the drain wires 31.

Figure 2:
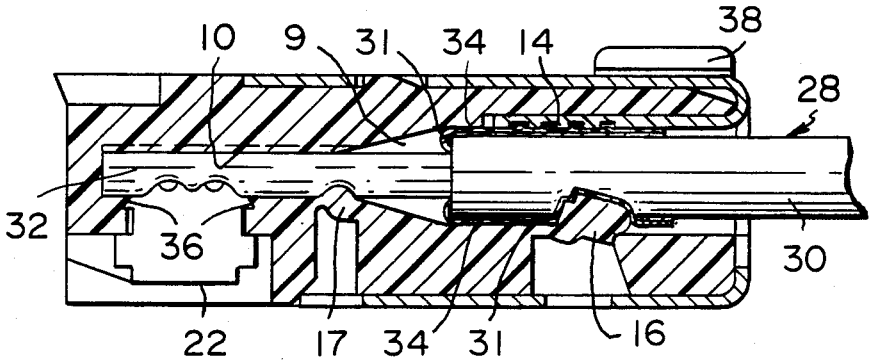
FIG. 2 is a similar view to that of FIG. 2 but showing the cable terminated to the connector.

In order to terminate each of the conductors 32 of the cable 28 to a corresponding one of the contacts 22, the insulating sheath 30 is first stripped from an end portion of the cable to expose end portions of the conductors 32 and the shield 34 is longitudinally slit at each end of the row of conductors 32 two opposed flaps so formed in the shield are then bent back to lie along the sheath 30, the drain wires 31 being similarly bent back. When it has been so prepared, the end portion of the cable 28 is inserted into the cavity 6 as shown in FIG. 2, so that the conductors 32 enter the portion 10 of the cavity 6, whilst the adjacent end portion of the sheath lies in the portion 8 of the cavity 6, and the reentrant portion 14 of the shield 12 of the connector 2 engages one of the bent back flaps of the cable shield 34. The members 16 and 17 are then forced inwardly of the housing 4 so as to penetrate the insulating sheath 30 and to grip the conductors 32, respectively, to prevent withdrawal of the cable 28 from the cavity 6, and the contacts 22 are simultaneously forced inwardly of the opening 20 so that the prongs 26 pierce the insulation of the conductors 32 and make electrical contact with the electrically conductive cores thereof. Each contact 22 is retained in this inward position, by means of further barbs 36 thereon which then bite into the walls of the opening 20.

When the cable 28 has been terminated thereto in the manner described above, the connector 2 can be inserted into a jack, i.e. a receptacle (not shown) having contact springs therein for engaging the contact surfaces 24 of the contacts 22, the connector 2 being retained in the jack by means of latch arms 38 on the housing 4.

For a better understanding of the cable preparation and terminating techniques described above, reference may be made to US-A-3,860,316 and patent application No. 660,626, filed on Oct. 15, 1984, both of which are incorporated herein by reference.

Apparatus for terminating cables 28 to connectors 2 will now be described in outline mainly with reference to FIG. 14.

Figure 14:
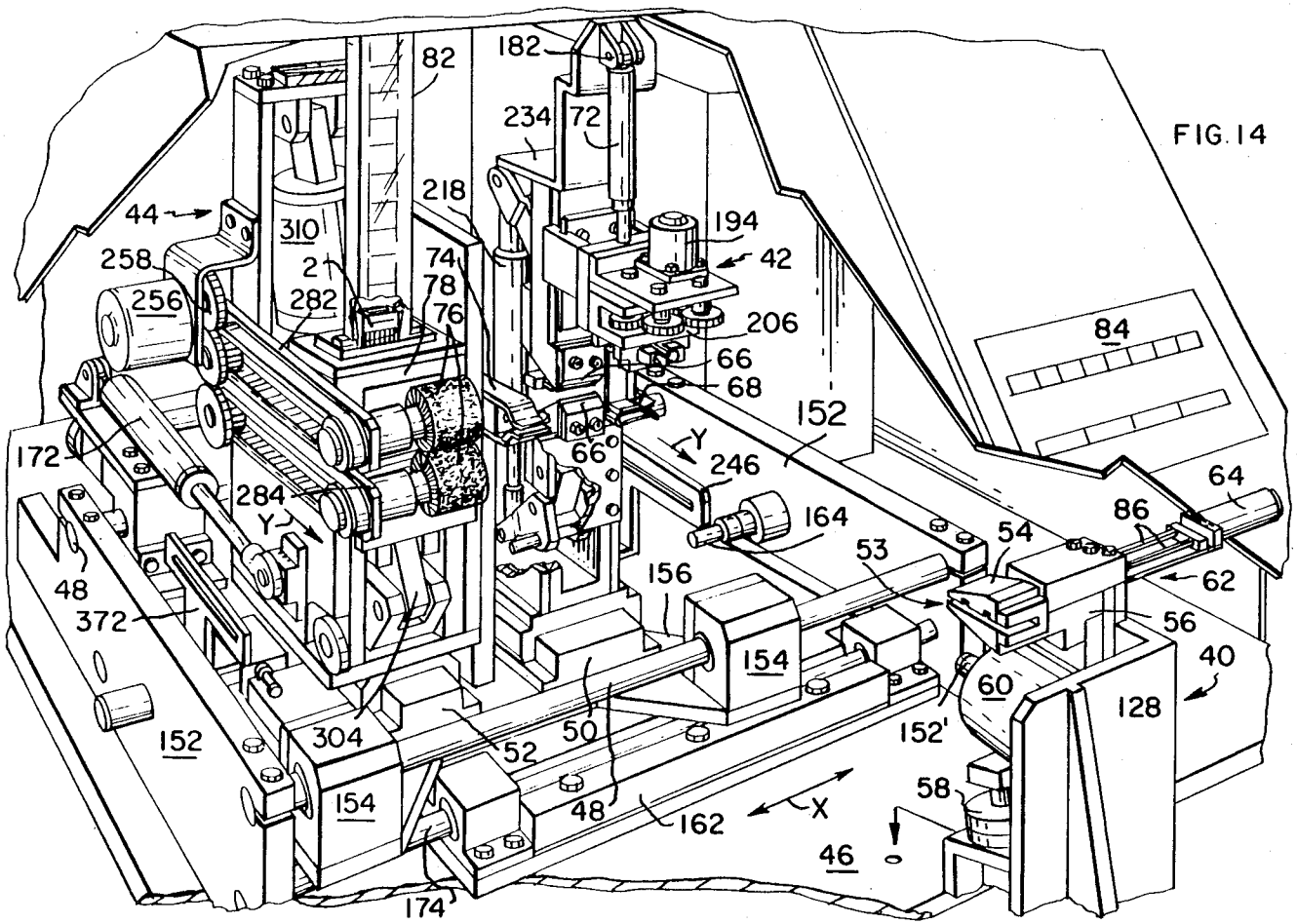
FIG. 14 is a perspective view of the apparatus with part of the cover thereof removed.

The apparatus basically comprises, as shown in FIG. 14, a cable clamp assembly 40 (shown as being exploded from the apparatus), a cable end stripping and preparation assembly 42, and a cable shield fold back and connector applicator assembly 44. The assembly 40 is fixed to a base plate 46 of the apparatus, the assemblies 42 and 44 being mounted on a table 156 which is translatable along an X axis from left to right and from right to left (as seen in FIG. 14) along rails 48, past the assembly 40. The assemblies 42 and 44 are translatable individually, each along a Y axis, which is perpendicular to the X axis, towards and away from the assembly 40 on slideways 50 and 52 on the table 156.

The clamp assembly 40 comprises a cable clamp 53 having an upper jaw 54 and a lower jaw 56 which is movable by means of a piston and cylinder unit 58 to open and close the cable clamp 53, a pusher piston and cylinder unit 60 for assisting movement of the assembly 42 away from the assembly 40, and a finished lead ejector device 62 comprising ejector rams 86 actuable by means of a piston and cylinder unit 64. Means, described below, are also provided for placing the clamp 53 in a partially open, cable receiving, position.

The cable end stripping and preparation assembly 42 comprises cable sheath stripping blades 66 which are movable between an open and a closed position by means described below, a cable guide 68, and cable shield slitting rolls 70 (see FIGS. 23 and 24A) which can be raised and lowered by means of a piston and cylinder unit 72.

A cable shield opening, blower device 74 is fixed to the table 156 between the assemblies 42 and 44.

The fold back and applicator assembly 44 comprises a pair of cable shield fold back, rotary wire brushes 76 which are opened and closed by means described below, a connector applicator 78 having an applicator ram 80 (FIG. 21) and, mounted on the applicator 78, a magazine 82 containing a supply of connectors 2 and from which the connectors 2 are fed by gravity into the applicator 78.

The moving parts described above are, during each cycle of operation of the apparatus, operated according to a predetermined program, under the control of a control unit 84 into which the program has been fed.

The operation of the apparatus will now be described in outline mainly with reference to FIGS. 4 to 13.

Figure 5:
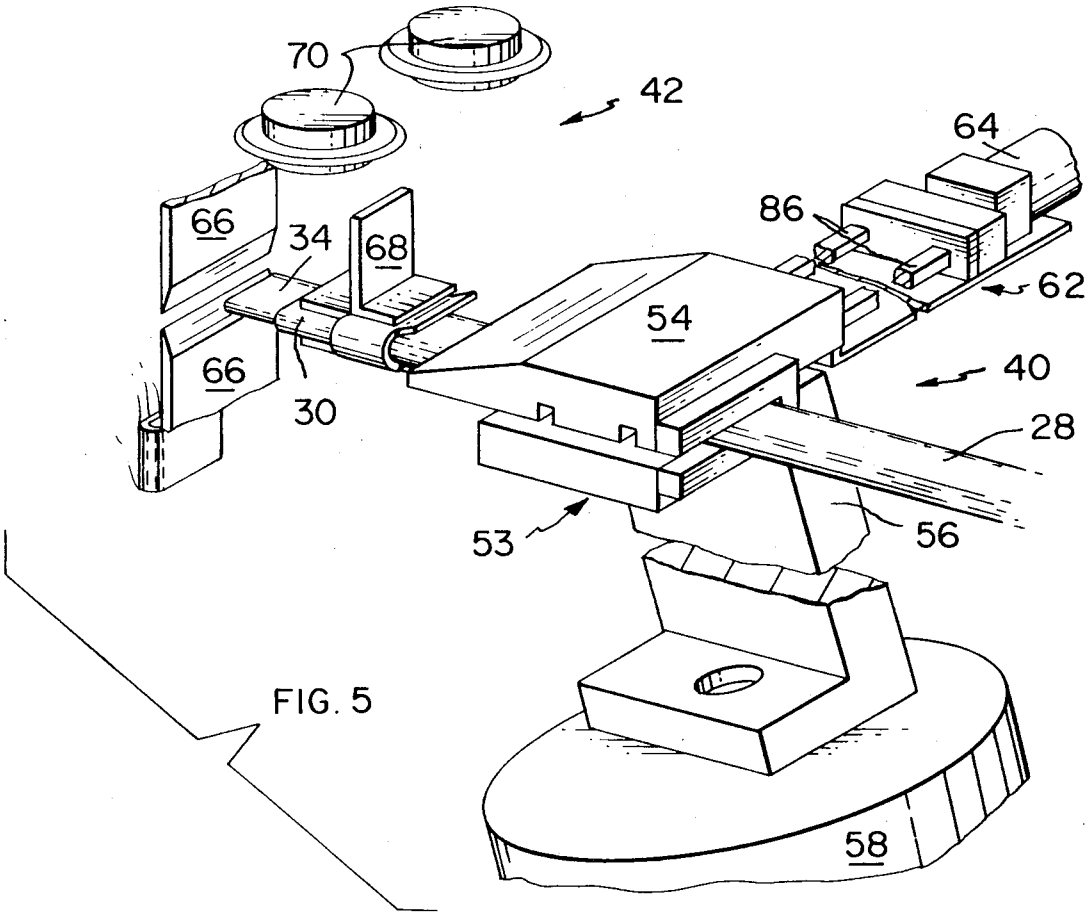
Figure 6:
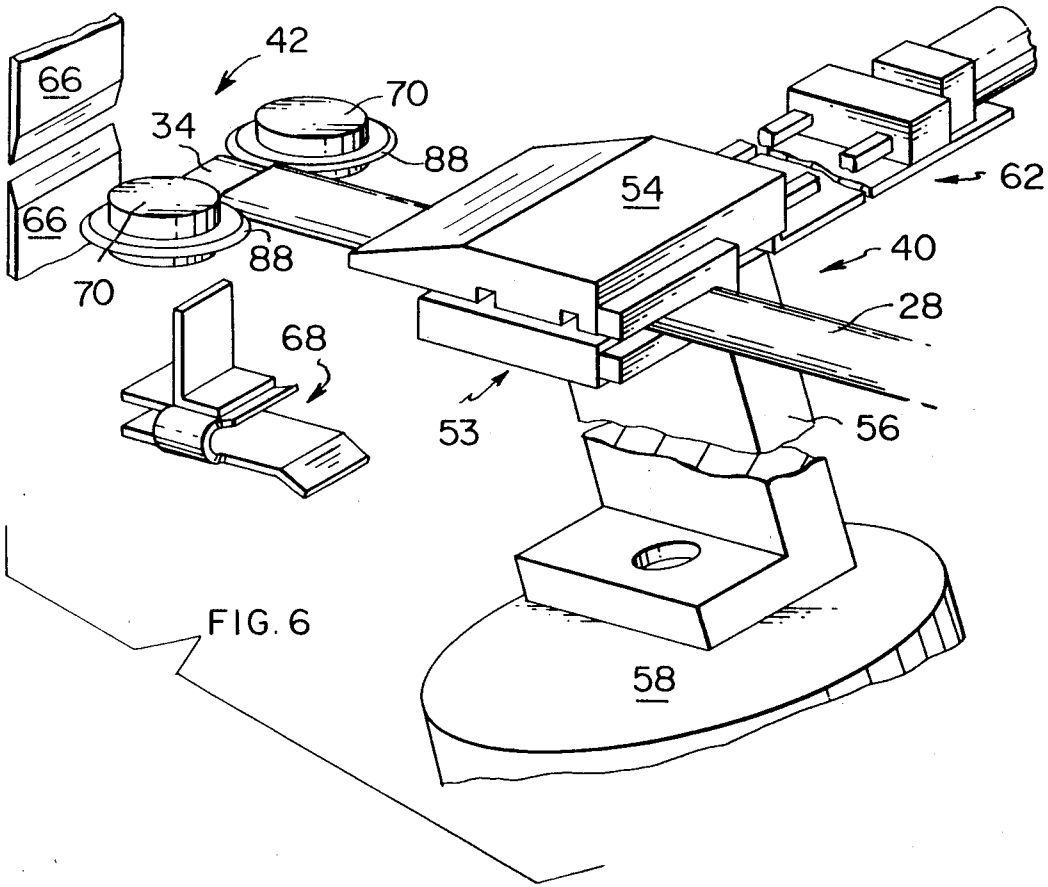

At the beginning of the cycle of operation, (FIG. 4) the assemblies 42 and 44 are in their leftmost position along the X axis the assembly 42 being in an advanced position along its Y axis towards the assembly 40, with the rolls 70 in a raised position and the blades 66 in an open position opposite to the cable clamp 53. The cable guide 68 is positioned in alignment with the clamp 53. The clamp 53 is in its cable receiving position and the rams 86 of the ejector device 62 are in a retracted position. The end of a cable 28 to be terminated is now inserted, by the operator, between the jaws 54 and 56 of the clamp 53, which are in said partially open position, through the cable guide 68, and between the blades 66 until the end of the cable butts against a limit switch 236 (FIG. 23), behind the blades 66, to actuate the control device 84 to initiate a cycle of operation of the apparatus. The jaws 54 and 56 are now fully closed to grip the cable 28, the blades 66 are closed about the cable 28 to sever the insulating sheath 30 thereof at a position back from the end of the cable 28 determined by the position of the limit switch 236 and, as shown in FIG. 5, the assembly 42 is retracted along its Y axis, with the aid of the unit 60 the piston rod 152' of which is extended to engage the assembly 42, so that the closed blades 66 strip the severed portion of insulation from the cable shield 34 and the cable guide 68 is retracted with the assembly 42. As the assembly 42 is being retracted, the cable guide 68 clears the end of the cable 28 and the rolls 70, which are in rotation, are lowered (FIG. 6), to a position just in front of the cable end and the assembly 42 is then further advanced along its Y axis by a short distance to contact the piston rod 152' which remains extended to act as a stop for the assembly 42. Circular cutting blades 88 projecting from the rolls 70 thereby engage opposite sides of the stripped portion of the cable shield 34 and slit the bared portion of the shield 34 longitudinally, so as to divide it into two flaps 34' and 34'' (see FIG. 7). The blades 88, also slit the insulating sheath 30 longitudinally for a short distance back from its severed end. The assembly 42 is then retracted again and at the same time the piston rod 152' is retracted. This cable shield and cable sheath slitting technique is described in detail in patent application No. 728,722 filed Apr. 30, 1985, and which is incorporated herein by reference. The cable guide 68 is lowered with the rolls 70 to a position below the cable end.

Figure 7:
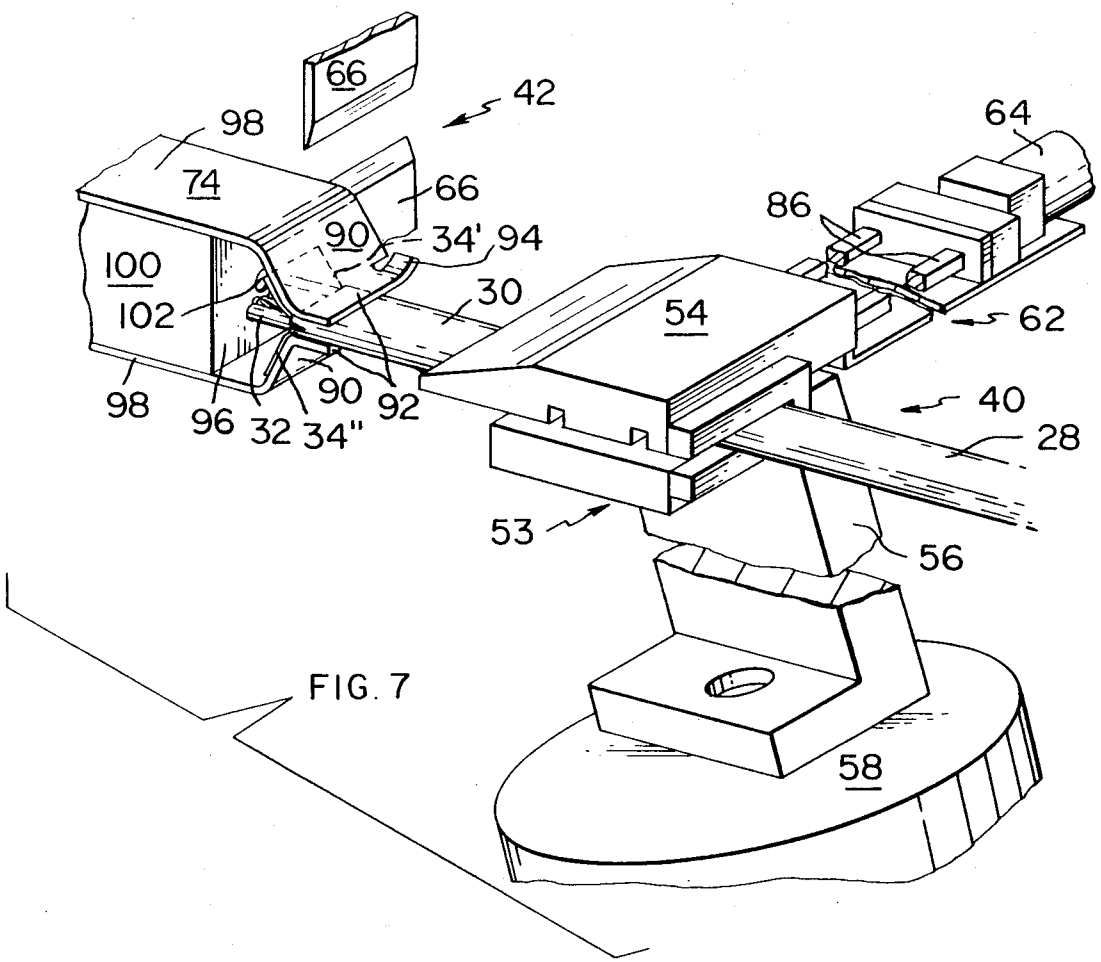
Figure 8:
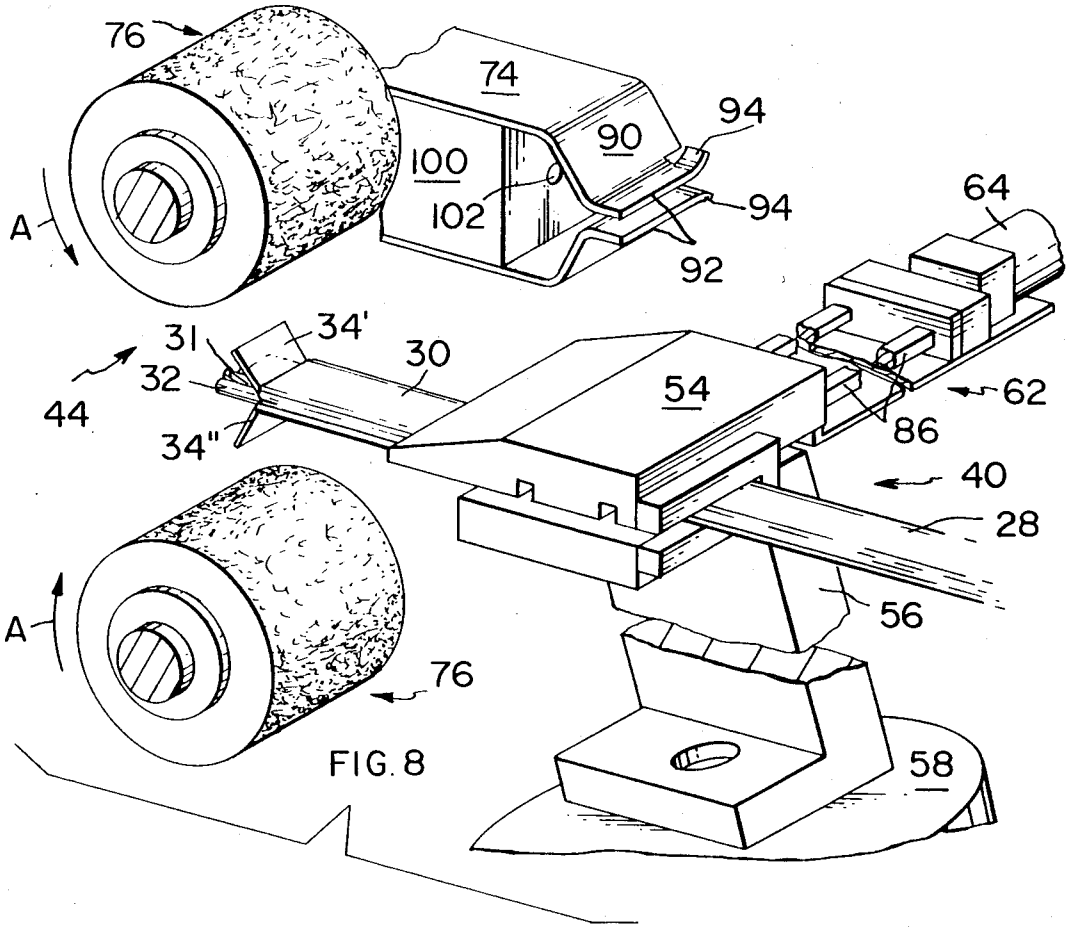

The table 156 is now advanced along the X axis so that the assemblies 42 and 44 are moved together rightwardly (as seen in FIG. 14) and the stripped cable end portion is received between flanges 90 of the device 74, as shown in FIG. 7. The flanges 90 have parallel, cable guiding portions 92 with arcuate guide lugs 94 defining a mouth for guiding the cable therebetween, and divergent, cable shield stop portions 96 angled by about 30 degrees with respect to the portions 94 and extending from parallel flat plates 98 on either side of a blower box 100. The box 100 has a bore 102 emitting an air stream which separates the flaps 34' and 34'' of the cable shield 34 and drives them flat against the portions 96 as shown in FIG. 7. The advance of the assemblies 42 and 44 along the X axis is continued until the table 156 reaches an end position in which the cable end portion, is located in front of the brushes 76 of the assembly 44, which are in an open position as shown in FIG. 8, and rotate in opposite senses, as indicated by the arrows A in that figure. The brushes 76 are then closed and the assembly 44 is advanced along its Y axis so that the brushes 76 fold back the flaps 34' and 34'' flat against the cable sheath 30 (FIG. 9) and lay the drain wires 31 back against the respective flaps 34' and 34'', as shown in FIG. 9.

Figure 9:
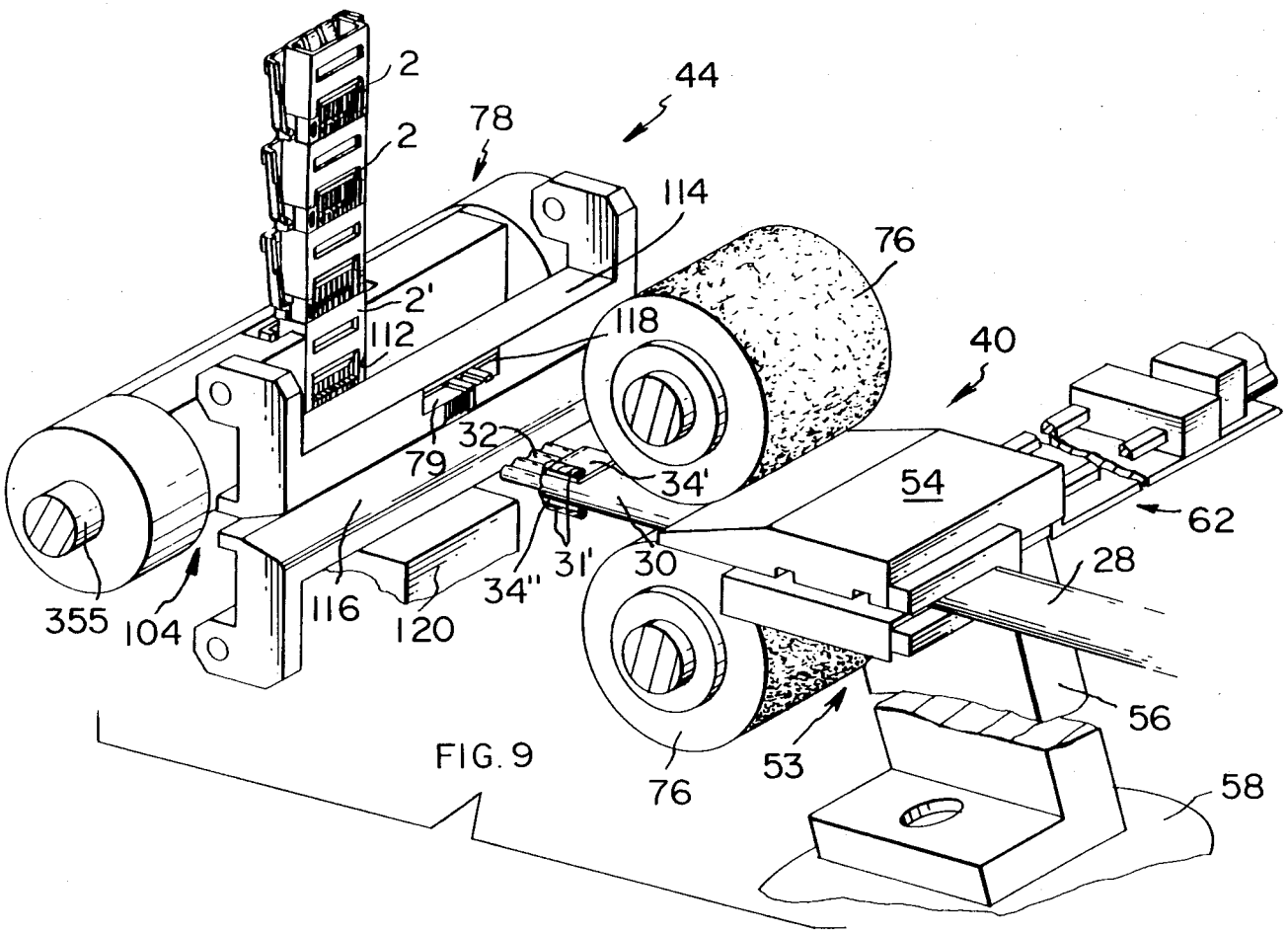
Figure 10:
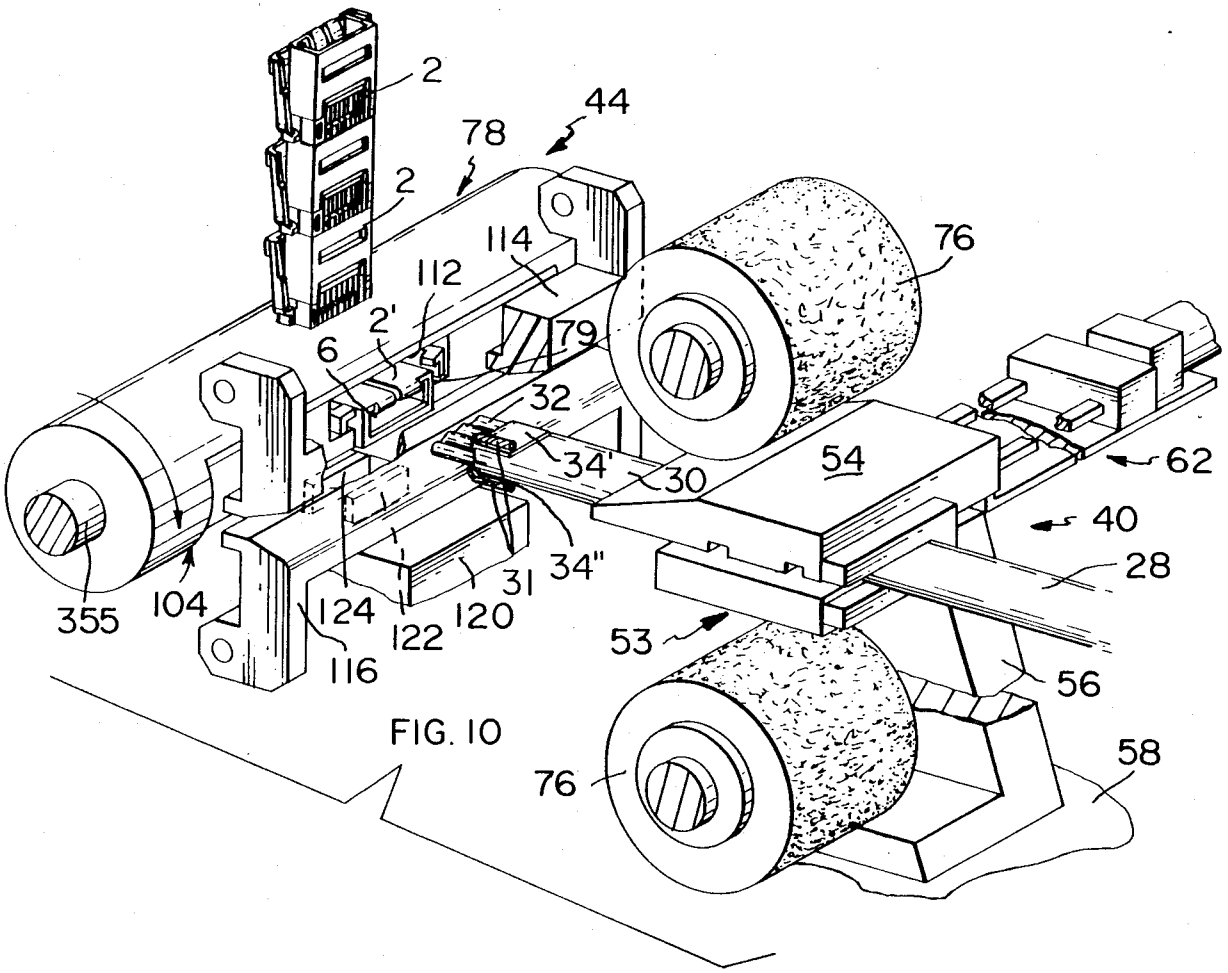

The applicator 78 comprises a roller 104 (FIGS. 9 to 12) having a central recess 112 which is aligned with the magazine 82 to receive the leading connector 2' therein through a mouth 79 of the recess, when the roller 104 is in the angular position in which it is shown in FIG. 9. Prior to the table 156 reaching said end position, the roller 104 is rotated to the position in which it is shown in FIG. 10 to bring the mouth of the cavity 6 of the connector 2' into register with the cable end. The roller 104 thus acts as an escapement means.

Figure 11:
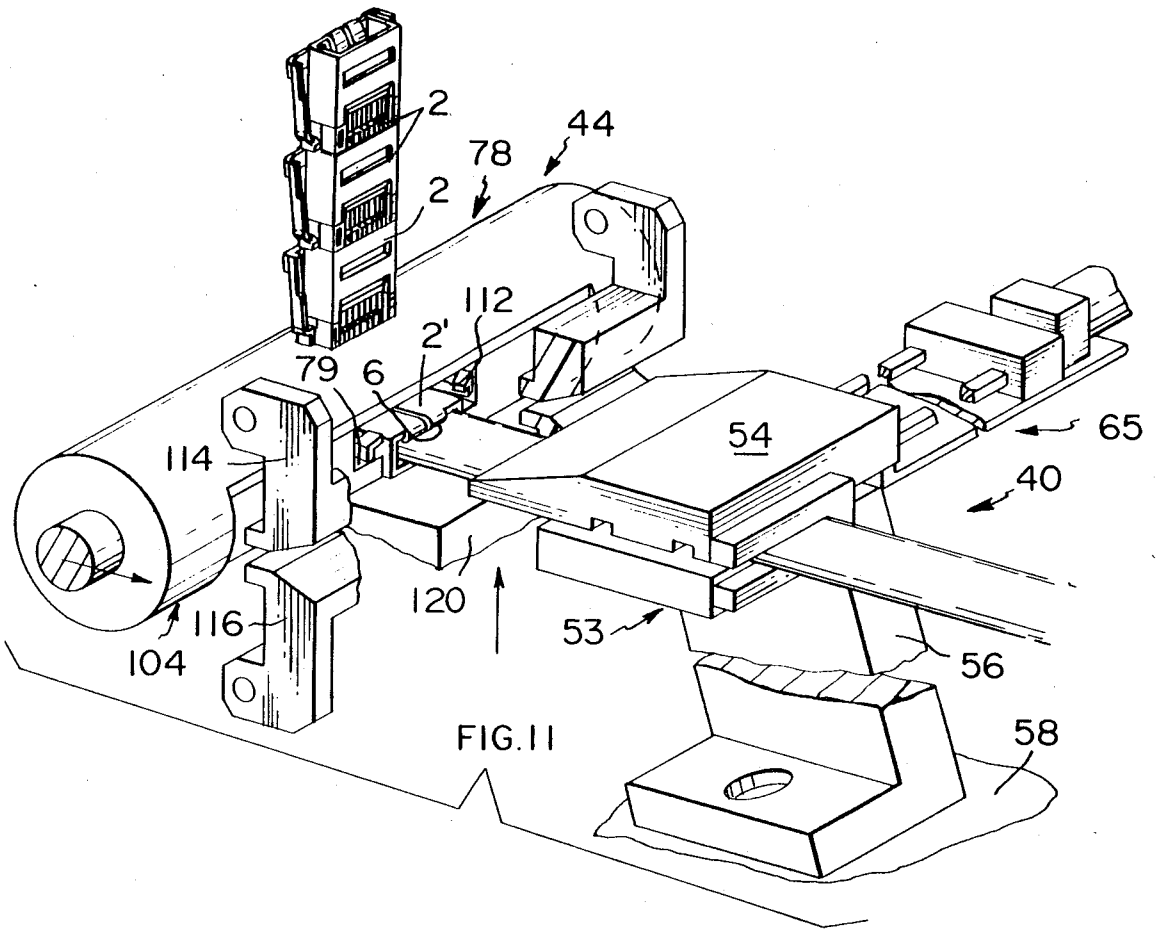
Figure 12:
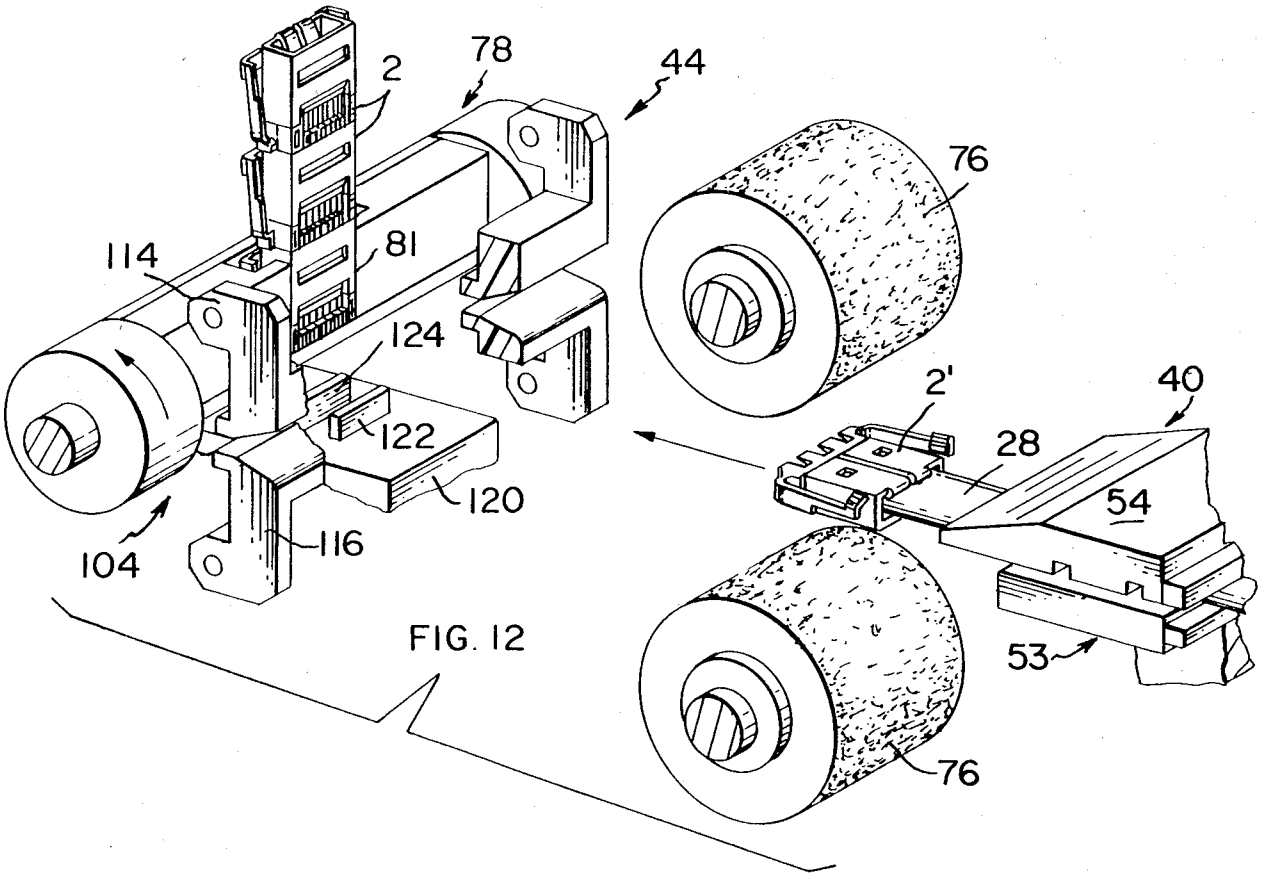
Figure 13:
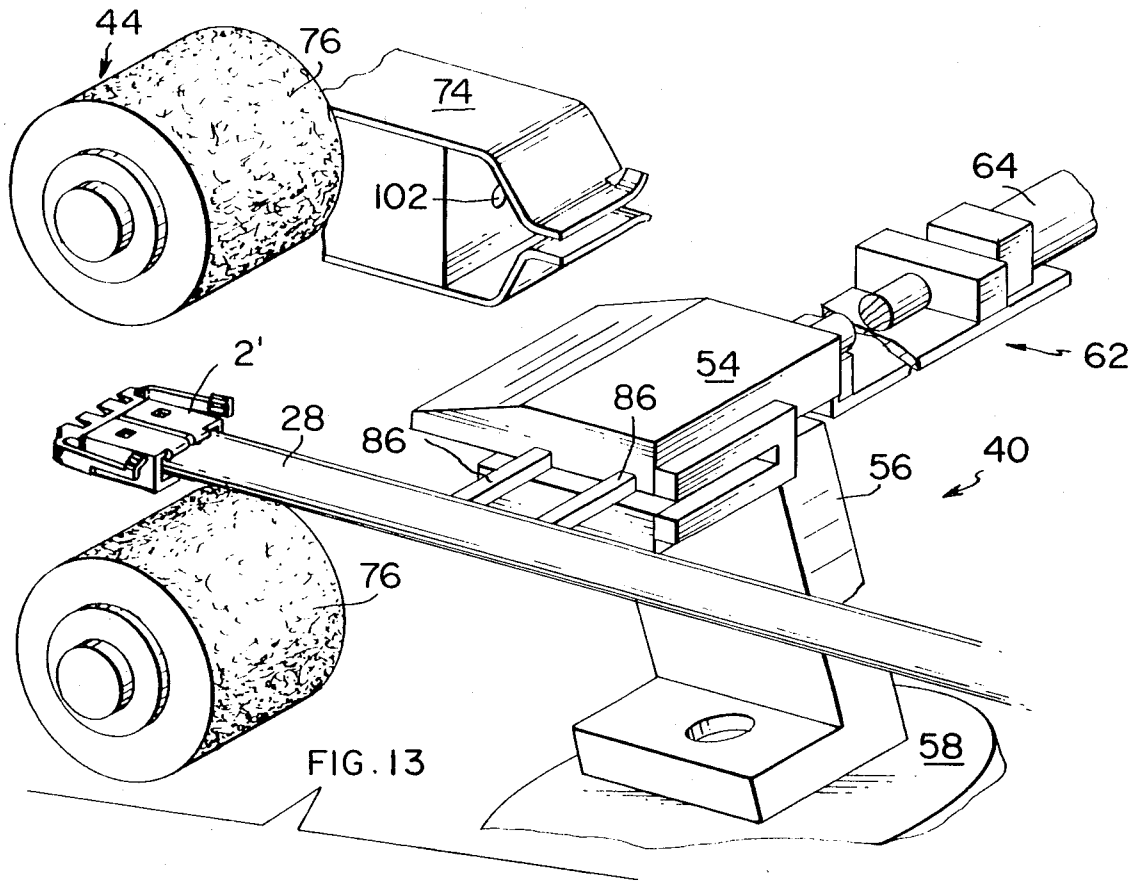

As the assembly 44 further advances along its Y axis, the brushes 76 are opened so as to straddle the cable clamp 53, and the cable end enters the cavity 6 of the connector 2' as shown in FIG. 11 through a slot 118 defined by pivotally mounted cable guide lips 114 and 116 in front of the roller 104. The ram 80 is then raised, through a working stroke (FIG. 11) so that crimping bars 122 and 124 in a die 120 (FIG. 21) thereon, enter the openings 13 and 15, respectively, of the connector 2' through a mouth 81 of the recess 112, which mouth opens in a direction at right angles to the mouth 79, to drive the members 16 and 17 of the connector 2' against the sheath 30 and against the conductors 32, respectively, of the cable end portion and so that a further bar 125 (FIG. 21) on the die 120 drives in the contacts 22 of the connector 2' to make electrical connection with the cores of the insulated conductors 32 of the cable end, to terminate it to the connector 2'. The ram 80 is then driven through a return stroke. The assembly 44 is now retracted along its Y axis away from the clamp assembly 40, as shown in FIG. 12, so that the connector 2' to which the cable 28 has been terminated is withdrawn from the recess 112, the lips 114 and 116 being swung by the connector 2', against the action of return springs as described below, to allow the connector 2' to emerge from the recess 112. The roller 104 is then rotated back to its starting position and, the unit 58 is actuated fully to open the clamp 53 to advance the rams 86 through the clamp 53 as shown in FIG. 13, to eject the finished lead 2', 28 from the apparatus. Then the table 156 is returned to its starting position, the clamp 53 is partially closed and the unit 64 is actuated to return the rams 86; so that the apparatus is ready for a further cycle of operation.

The apparatus will now be described in greater detail, with reference to FIGS. 14 to 29.

Figure 28A:
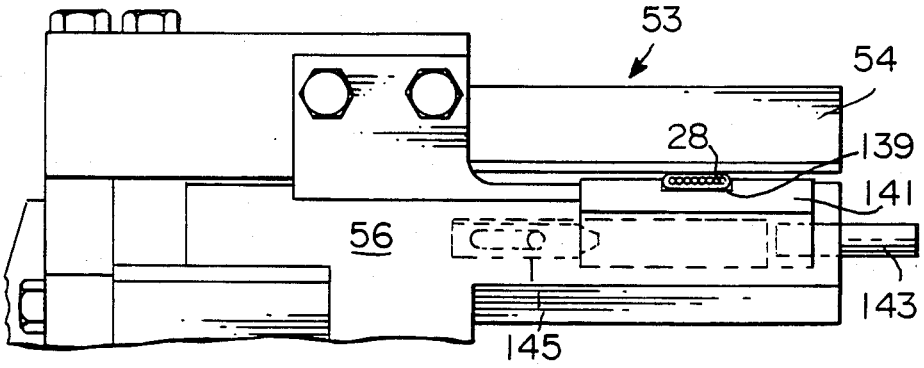
FIG. 28A is a fragmentary view taken in the direction of the arrow 28A in FIG. 28.
Figure 27:
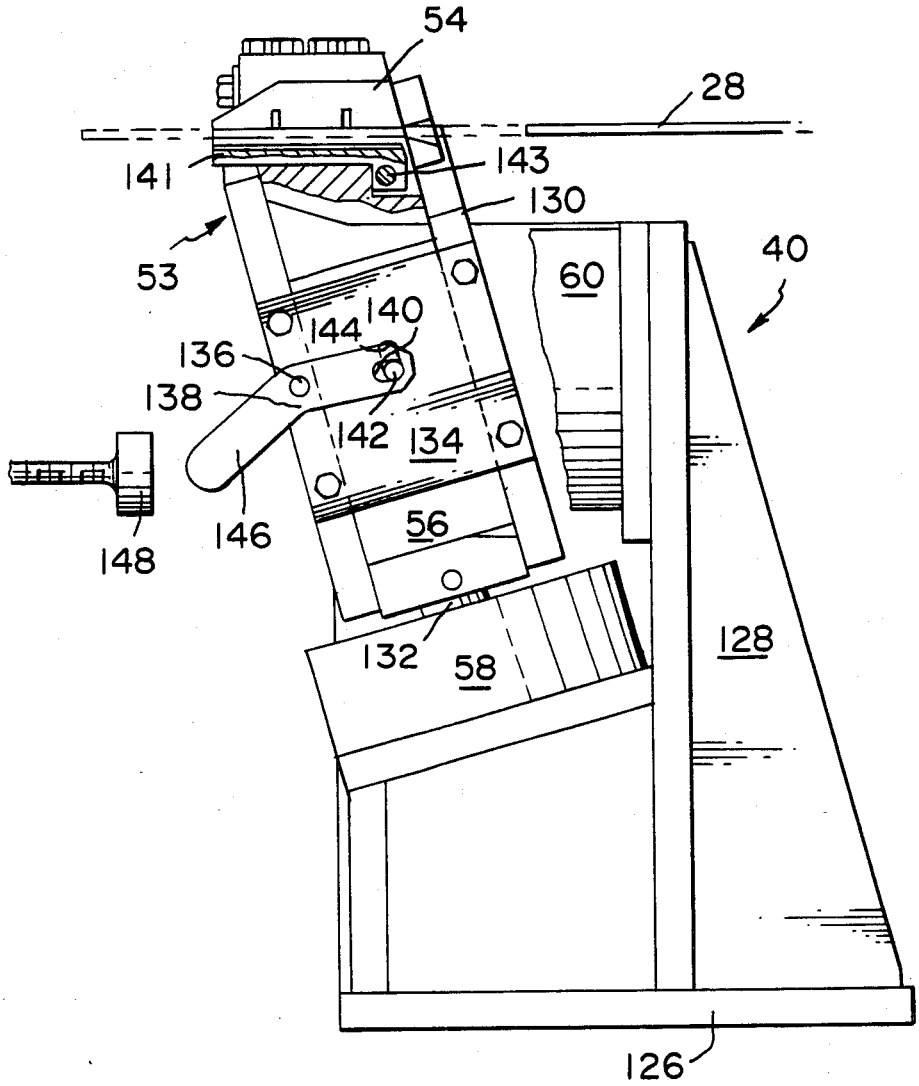
FIG. 27 is a side view, shown partly in section, of a cable clamping assembly of the apparatus, showing a cable clamp of that assembly in a fully open position.
Figure 28:
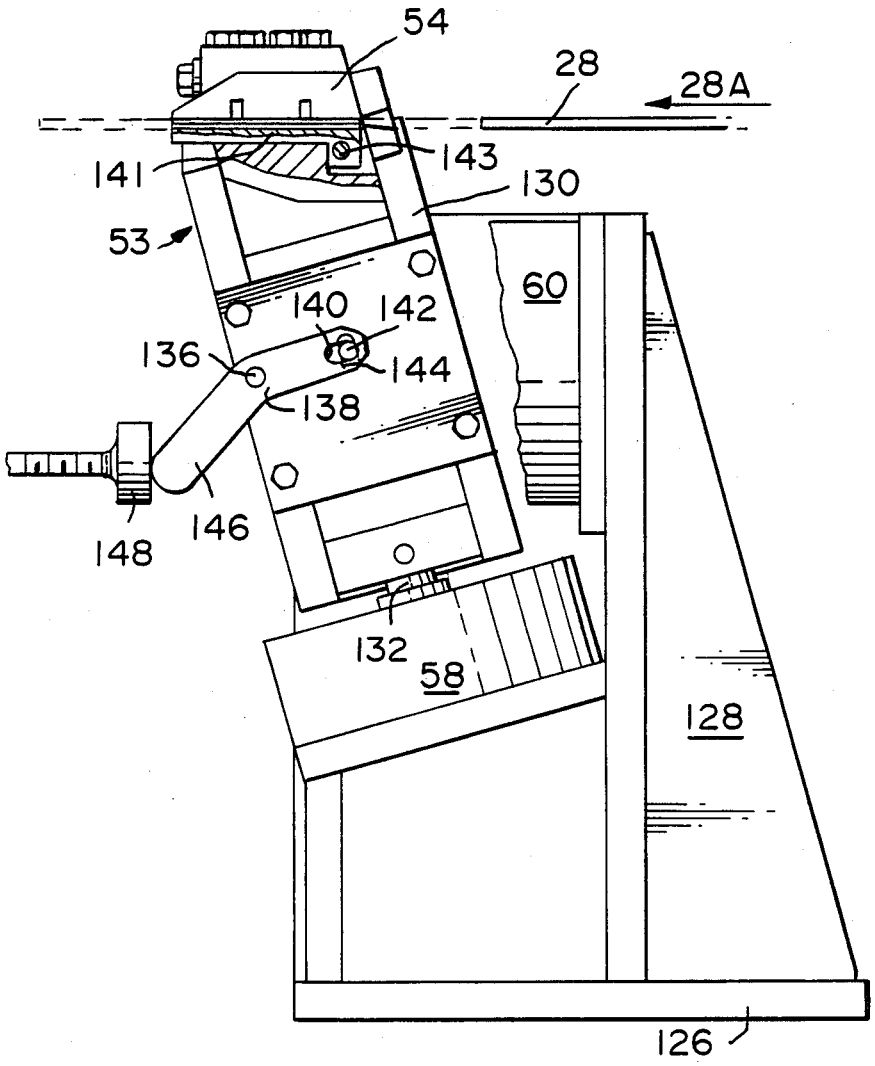
FIG. 28 is a similar view to that of FIG. 26 but showing the cable clamp in a partly open position.

As shown in FIGS. 15 and 27 to 29, the cable clamp assembly 40 comprises a base plate 126 which is secured to the apparatus base plate 36. A mounting bracket 128 extending from the plate 126 carries the piston and cylinder units 58 and 60 and a frame 130 slidably receiving the jaw 56 which is connected to the piston rod 132 of the unit 58 and is confined between cover plates 134 fixed to the frame 130. A jaw partial closure lever 138 pivotally attached to the frame 130 by means of a pin 136, has, in one end, a slot 140 receiving a pin 142 fixed to the jaw 56 and projecting therefrom through a slot 144 in the plate 134, the slot 144 extending transversely of the slot 140. The other end, 146, of the arm 138, projects from the frame 130 for engagement by a bumper 148 projecting from the assembly 42 as shown for example in FIG. 20. Prior to the advance of the rams 86 to eject the finished lead, as described above with reference to FIG. 13, the unit 58 is actuated to withdraw its piston rod 132 fully to withdraw the jaw 56 from the jaw 54 of the cable clamp 53 to allow the ejection of the finished lead. When the assemblies 42 and 44 have been returned along the X axis to their starting positions, as described above, the unit 42 is advanced along the slideway 50, until the bumper 148 has engaged the end portion 146 of the lever 138 (as shown in FIG. 28) to tilt it about the pin 136 so that the jaw 56 is advanced to a partially closed position in relation to the jaw 54 so that the cable 28 can be inserted into a nest 139 (FIG. 28A) between the jaws 54 and 56 by the operator, without substantial play. If the cable 28 were so inserted in the fully open position of the jaw 56, in which position it is shown in FIG. 27, the cable 28 would not be properly aligned with the stripping blades 66 or the cable guide 68. The nest 139 is formed in an insert 141 having a handle 143 and secured to the jaw 56 by means of a screw 143 and a spring loaded pin 145 (FIG. 28A) so that the insert can be exchanged to allow for cable size.

Figure 29:
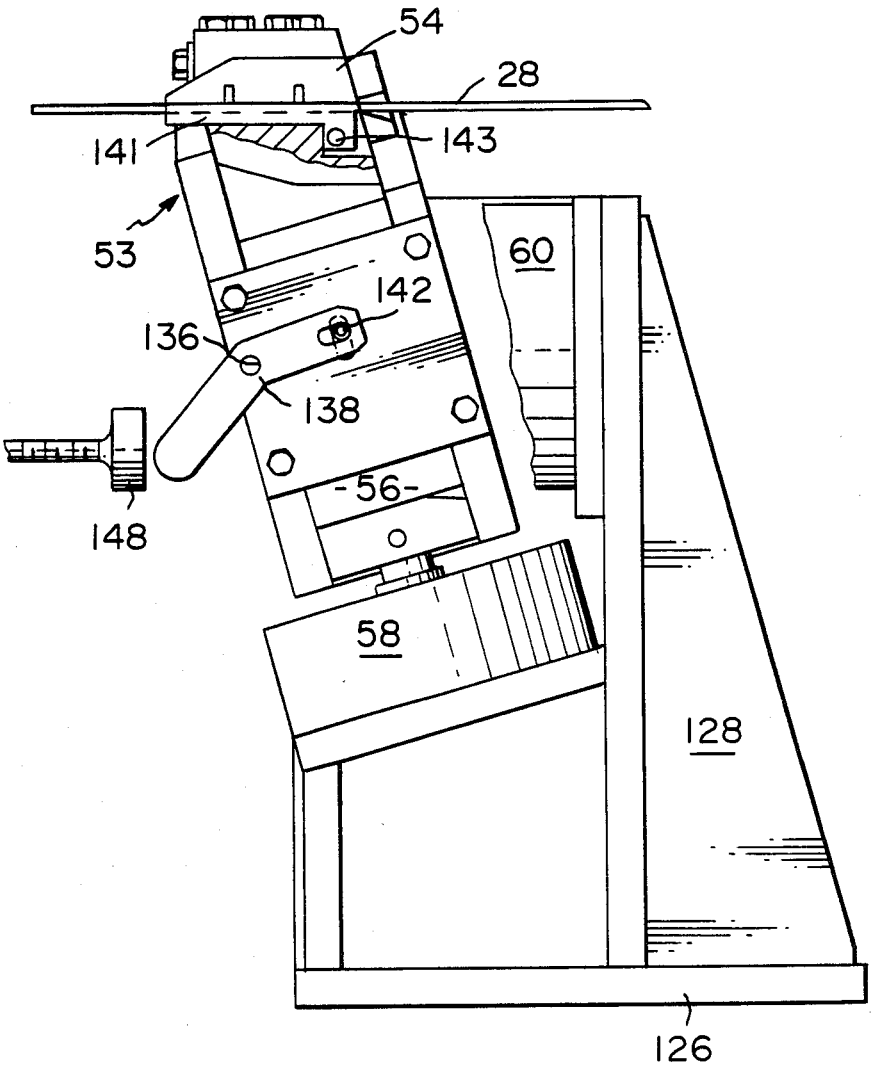
FIG. 29 is a similar view to that of FIGS. 27 and 28 but showing the clamp in a closed position.

When the end of the cable 28 engages the limit switch 236, so that the assembly 42 is retracted, the bumper 148 is withdrawn from the lever 138 and the unit 58 is simultaneously energized to advance its piston rod 132 so that the cable 28 is tightly clamped between the jaw 54 and 56 as shown in FIG. 29.

Figure 15:
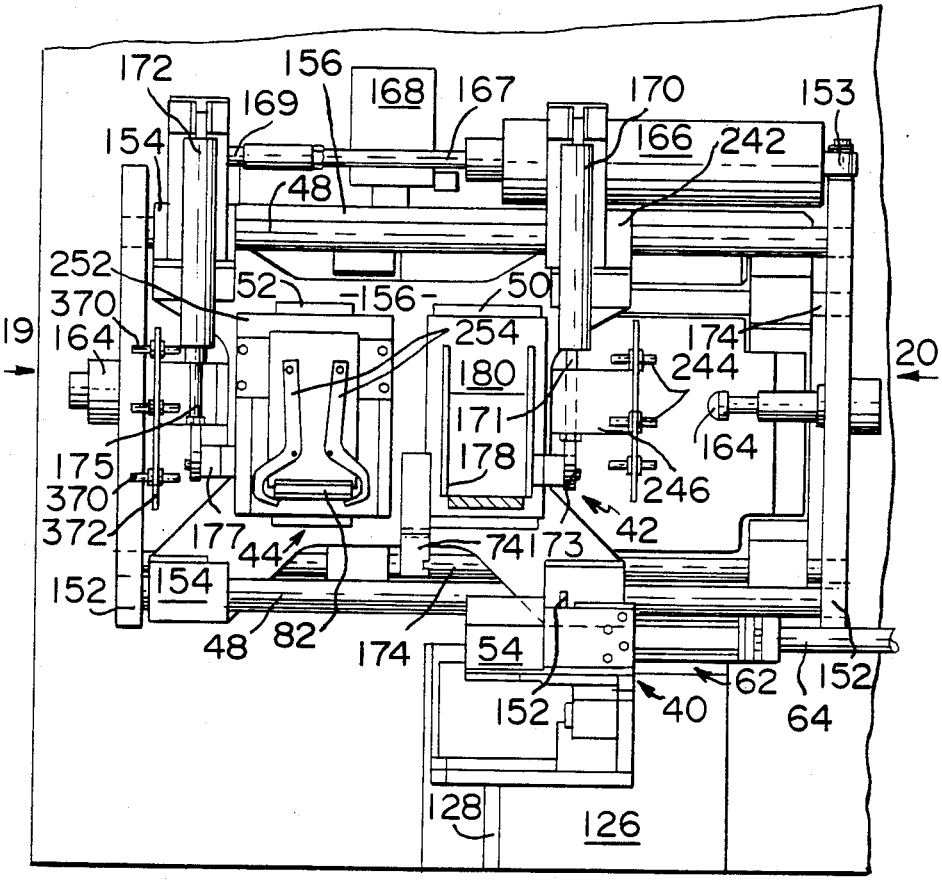
FIG. 15 is a plan view of the apparatus with parts removed.
Figure 16:
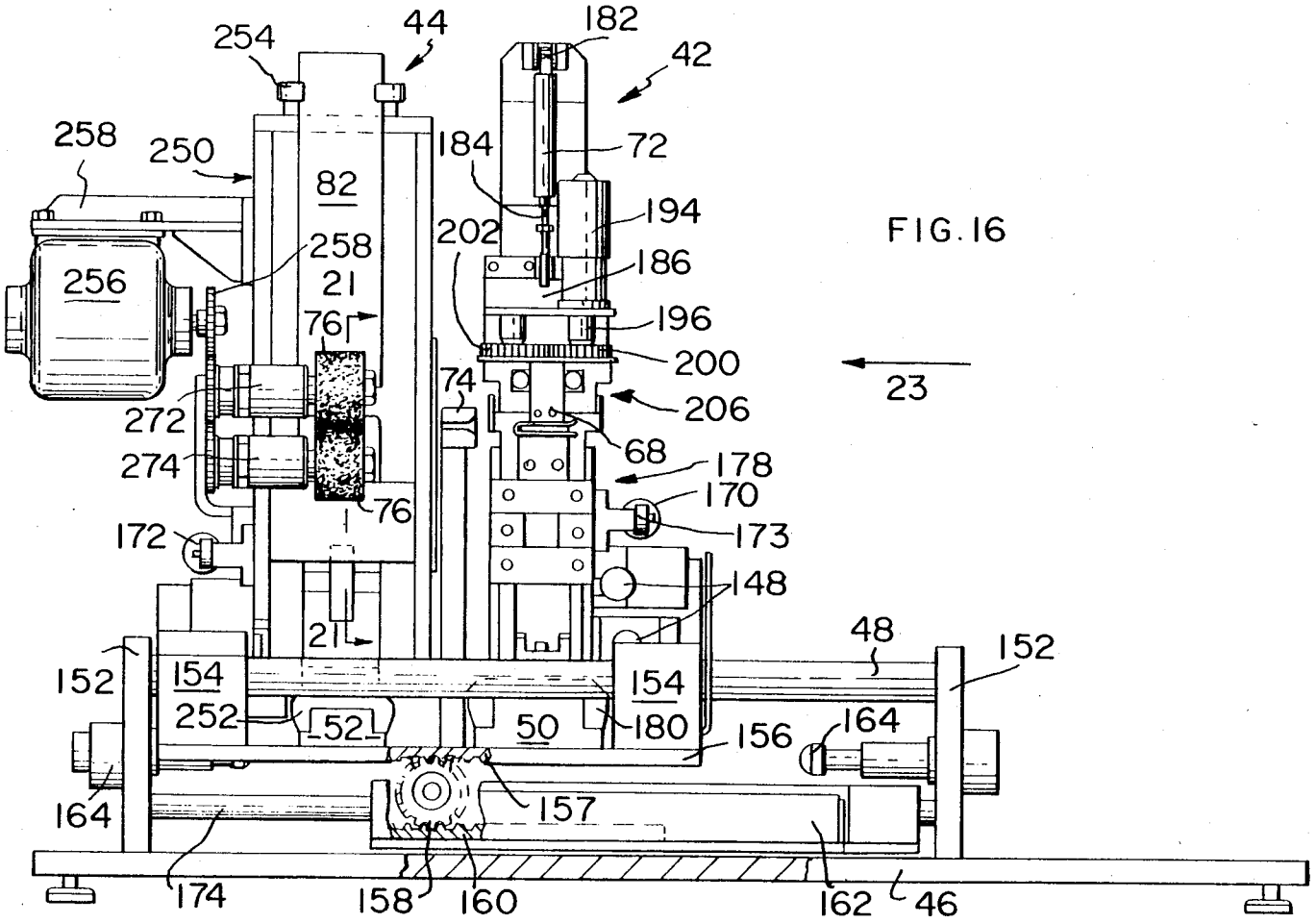
FIG. 16 is a view taken in the direction of the arrow 16 in FIG. 15.

As best seen in FIGS. 15 and 16, the rails 48, are supported on the base plate 46 in side plates 152, tooling supports 154 slidable along the rails 48, carrying the table 156 to which the slideways 50 and 52 are fixed. The underside of the table 156 is provided with a top rack 157 (FIG. 16), meshing with a pinion 158 which in turn meshes with a bottom rack 160 carrying a counterbalance 162 slidable along rails 174 mounted in the side plates 152. The pinion 158, which is free running, is carried by a bearing block 168. The travel of the table 156 along the rails 48 is limited by buffers 164. The counterbalance 162 is moved, through the pinion 158, always in the opposite direction to the table 156 carrying the assemblies 42 and 44, in order to counterbalance the inertial forces acting upon the stationary frame of the apparatus. The table 156 is driven along the rails 48 by means of a double acting piston and cylinder unit 166 anchored to the right hand side plate 142 at 153, as shown in FIG. 15, and having a piston rod 167 secured to the table 156 at 169.

As best seen in FIG. 15, the assembly 42 is advanced and retracted along the slideway 50 by means of a double acting piston and cylinder unit 170 having a piston rod 171 secured to the assembly 42 at 173 and the assembly 44 is advanced and retracted along the slideway 52, by means of a double acting piston and cylinder unit 172, having a piston rod 175 secured to the assembly 44 at 177.

Figure 20:
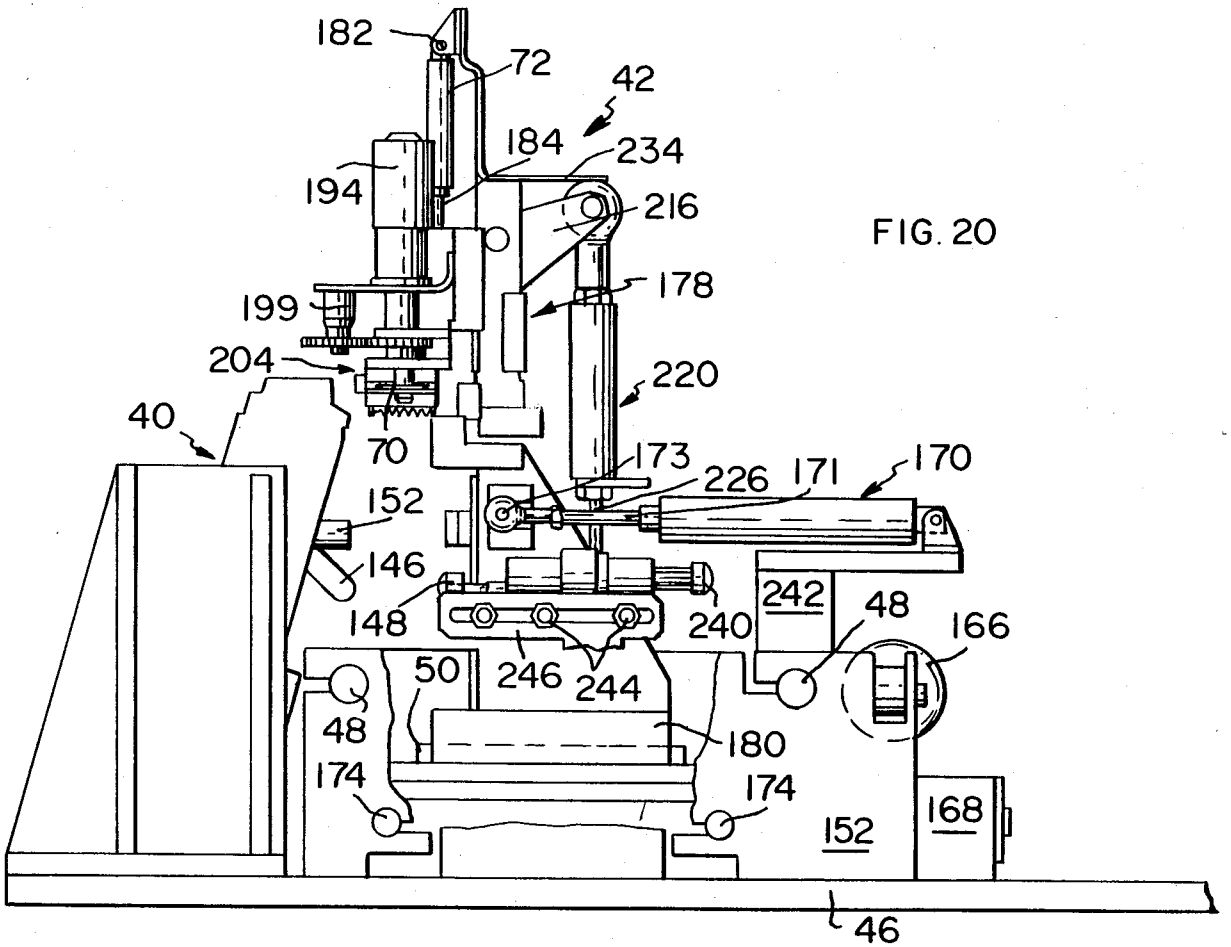
FIG. 20 is a view taken in the direction of the arrow 20 in FIG. 15.
Figure 23:
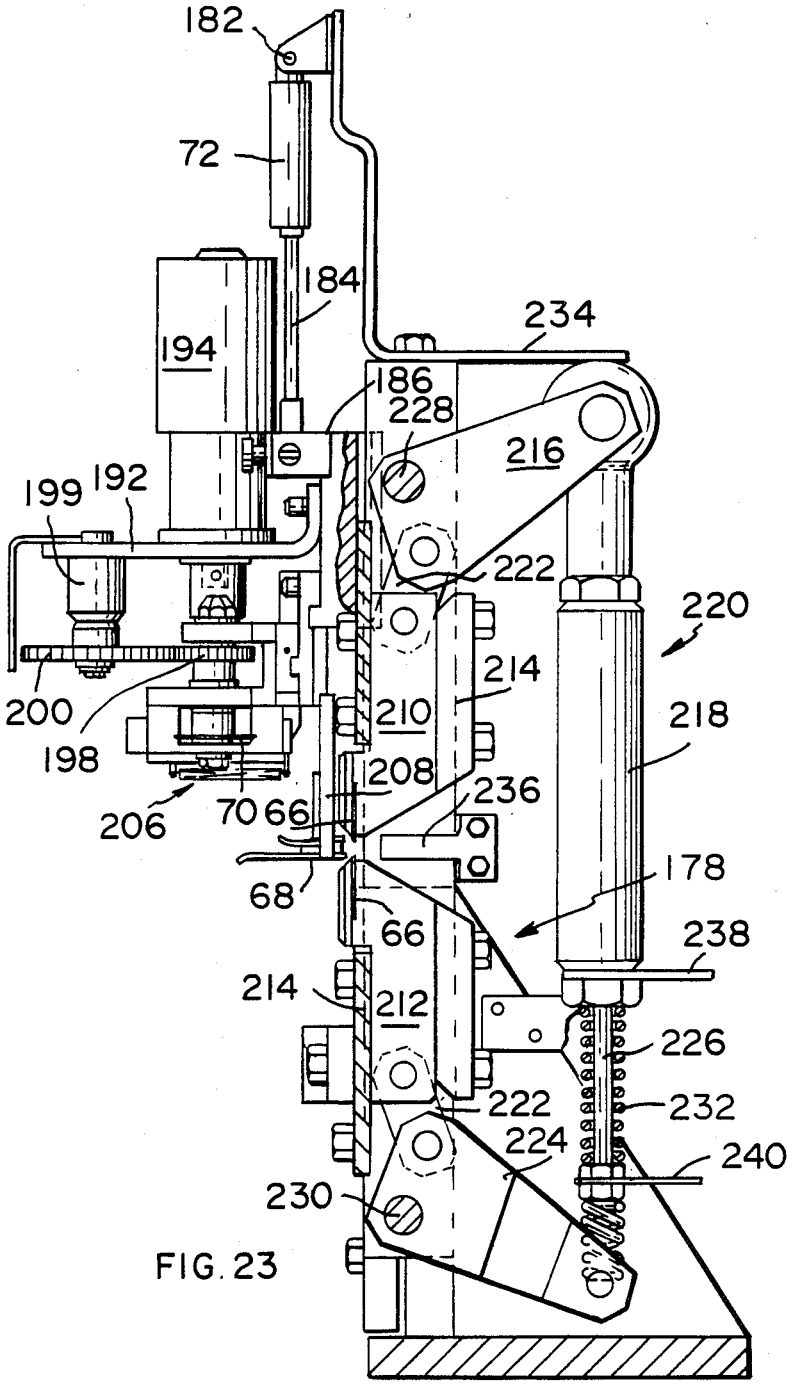
FIG. 23 is a view, shown partly in section, taken in the direction of the arrow 23 in FIG. 16.
Figure 24:
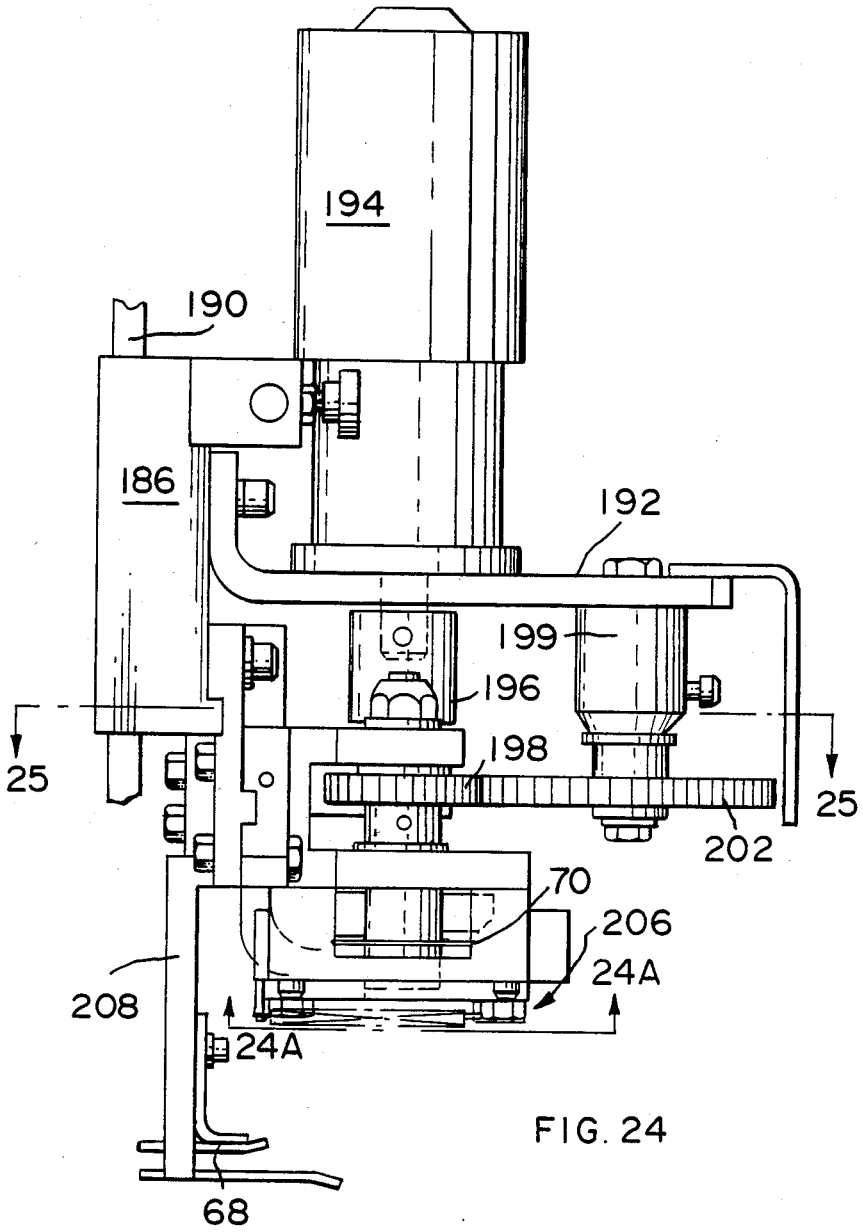
FIG. 24 is an enlarged fragmentary view illustrating details of FIG. 23.
Figure 24A:
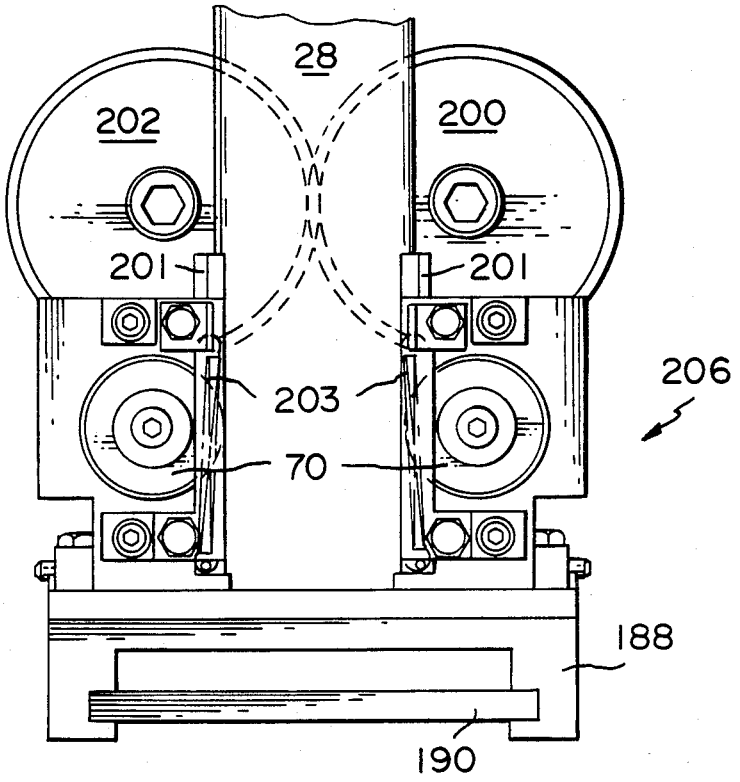
FIG. 24A is a view taken on the lines 24A—24A of FIG. 24.
Figure 25:
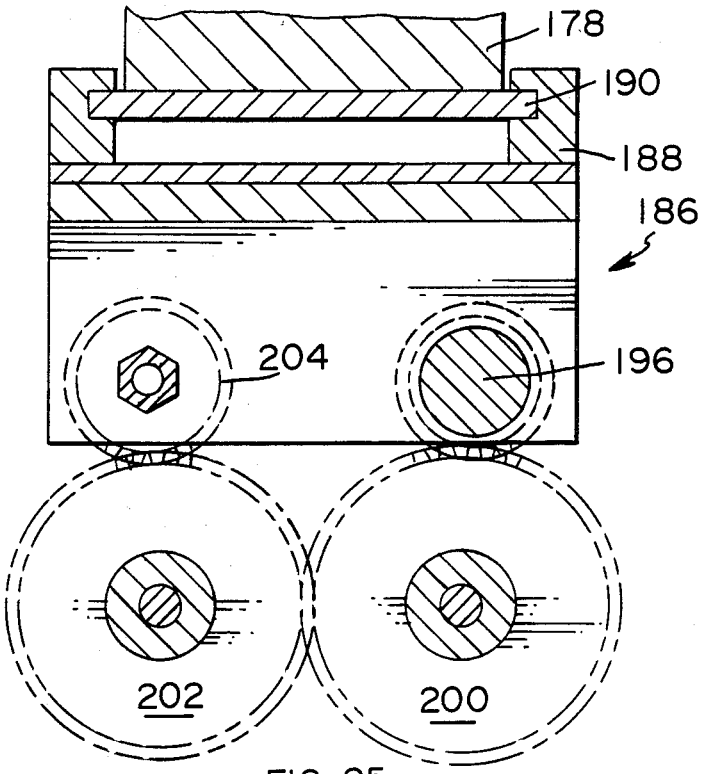
FIG. 25 is a view taken on the lines 25—25 of FIG. 24.

As best seen in FIGS. 16, 20 and 23, the assembly 42 comprises a frame 178 mounted on a slide 180 which is slidable along the slideway 50. The piston and cylinder unit 72 is pivotally attached at 182 to the upper (as seen in FIGS. 16, 20 and 23) end of the frame 178. The piston rod 184 of the unit 72 is secured to a slide 186 provided with gibs 188 receiving a plate 190 on the frame 178 as best seen in FIG. 25, so that the slide 186 is mounted for vertical reciprocating motion (by means of the unit 72) relative to the frame 178. A bracket 192 secured to the slide 186 carries an electric motor 194 for driving the rolls 70. The shaft 196 (see FIGS. 24 and 25) of the motor 194 drives one of the rolls 70 and has secured thereto a pinion 198 meshing with a gear wheel 200 having bearings 199 and which in turn meshes with a gear wheel 202, of the same size as the wheel 200, which wheel 202 drives a pinion 204 of the same size as the pinion 198 and which in turn drives the other roll 70, as shown in FIG. 25.

The rolls 70 are accommodated in a cable guide structure 206 (best seen in FIG. 24A) which is described in detail in the aforesaid patent application No. 728,722. The structure 206 comprises cable guides 201 which are advanced by the cable 28 as the structure 206 receives the cable end, relative to the rolls 70 and against the action of return springs 203, so that the cable is in effect overfed to an extent that the blades 88 of the rolls 70 cut into the sheath 30 as mentioned above. The wire guide 68 is secured to the slide 186 by means of a bracket 208, below the rolls 70 and the structure 206, for vertical reciprocating movement therewith.

The sheath severing blades 66 are mounted on respective blade carriers 210 and 212 which are vertically slidable in slideways 214 provided on the frame 178 (see FIG. 23). The blade carrier 210 is connected by way of toggle links 214 and 216 to the cylinder 218 of a single acting piston and cylinder unit 220, the blade carrier 212 being connected via toggle links 222 and 224 to the piston rod 226 of the unit 220. The link 216 is pivoted to the frame 178 on a pin 228, the link 224 being pivoted to the frame 178 on a pin 230 (as best seen in FIG. 23), so that when the piston rod 226 is retracted with the aid of a spring 232 the link 224 is first pivoted in an anticlockwise sense (as seen in FIG. 23) to raise the blade carrier 212 before the link 216 is rotated in the opposite sense to lower the blade carrier 210; to close the blades 66. The blades 66 are opened again upon the piston rod 226 being returned by the spring 232. The pins 228 and 230 comprise an eccentric feature for adjusting the shut height of the blades 66. Upward (as seen in FIG. 23) movement of the unit 220 is limited by a stop plate 234 projecting from the frame 178. Plates 238 and 240 projecting respectively from the cylinder 218 and the piston rod 226 cooperate with sensors (not shown) to signal the position of the blades 66, to the control unit 84.

The assembly 42 has a buffer 240, as shown in FIG. 20, for abutment with a support 242 for the piston and cylinder unit 170. The position of the assembly 244 in relation to the assembly 40, is signalled to the control unit 84 by means of sensors 244 supported by a bracket 246 mounted on the base plate 46. The blower device 74 is mounted on the table 156, adjacent to the assembly 42, as best seen in FIG. 16 and is connected to a compressed air source (not shown).

Figure 22:
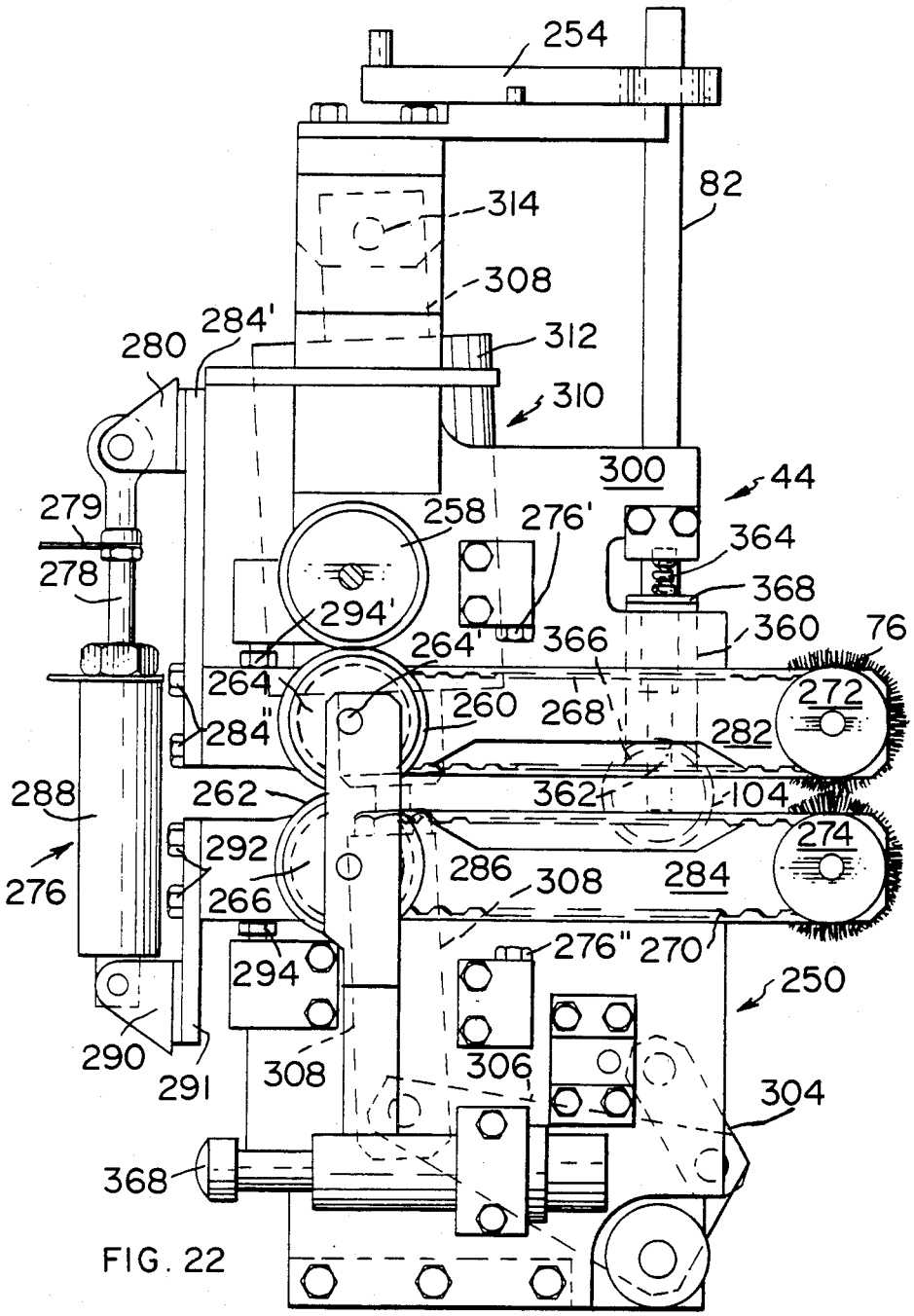
FIG. 22 is a fragmentary enlarged view illustrating details of FIG. 19.

As best seen in FIGS. 15 and 16, the assembly 44 comprises a frame 250 mounted on a slide 252 which is slidable along the slideway 52. The frame 250 is surmounted by a magazine clip 254 for the magazine 82. A brush drive motor 256 secured to the frame 250 by means of a bracket 258, as best seen in FIG. 16, drives the brushes 76 through a pinion 258 which meshes with a first brush drive gear 260 which in turn meshes with a second brush drive gear 262 as best seen in FIG. 22. The gears 260 and 262 are formed on brush drive pulleys 264 and 266 about which extend endless toothed belts 268 and 270 which also extend about pulleys 272 and 274 of the respective brushes 76. The brushes 76 are moved between their open and their closed positions by means of a piston and cylinder unit 276 having a piston rod 278 pivoted to the frame 250 in a clevis 280. The piston rod 278 carries a plate 279 for cooperation with a sensor (not shown) to signal the position of the rod 278 to the control unit 84. As best seen in FIGS. 14 and 22, the pulleys 264 and 272 are carried by an elongate plate 282 which is fixed to the clevis 280 via a plate 284' by fasteners 284", and is pivotally attached to the frame 250 by means of the spindle 264' of the pulley 264. The pulleys 266 and 274 are carried by an elongate plate 284 which is pivotally attached to the frame 250 by means of the spindle 286 of the pulley 266. The cylinder 288 of the unit 276 is pivotally attached to a clevis 290 on a plate 291 secured to the plate 284 by fasteners 292. Thus, when the piston rod 278 of the unit 276 is retracted, the plates 282 and 284 are swung about the spindles 264' and 286 to move the pulleys 272 and 274 away from each other to open the brushes 76 to an extent limited by stops 276' and 276", which are adjustable. When the piston rod 278 is advanced, the plates 282 and 284 are swung in the opposite angular senses about the spindles 264' and 286, to an extent limited by an adjustable stops 294 and 294' on the frame 250, to close the brushes 76.

Figure 21:
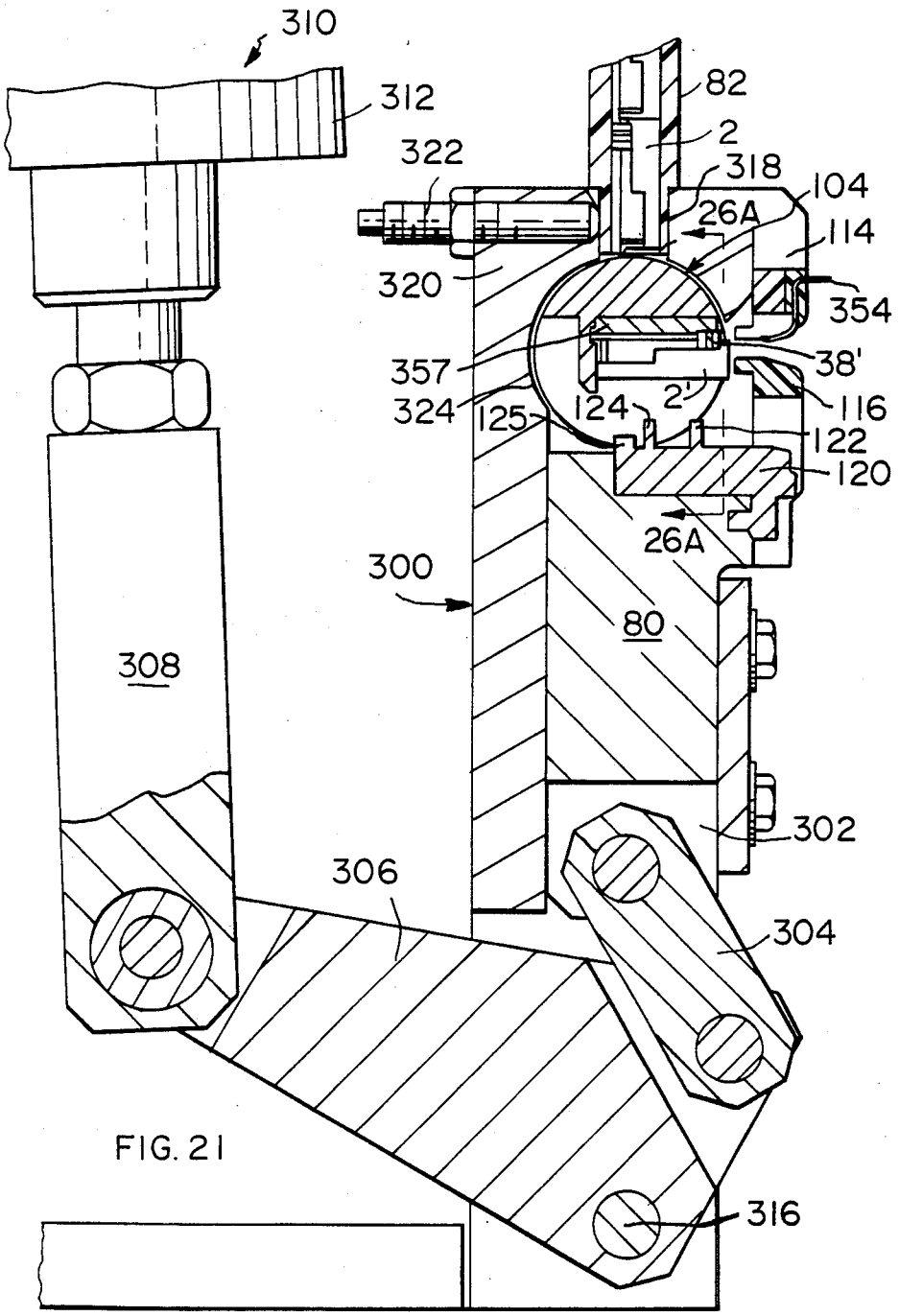
FIG. 21 is a view taken on the lines 21—21 of FIG. 16.

The frame 250 includes, as best seen in FIGS. 17, 18, 21 and 26A, an applicator subframe portion 300 comprising a roller support block 320 having an arcuate bore 324 which houses the roller 104, the portion 300 also housing the ram 80 carrying the die 120. At its lower (as seen in FIG. 21) end, the ram 80 is connected through a toggle linkage comprising links 304 and 306, to the piston rod 308 of a roller drive piston and cylinder unit 310, the cylinder 312 of which is pivotally connected, at 314, to the frame 240, as shown in FIG. 22. The link 306 is pivotally attached, by a pin 316, to the subframe portion 300 so that as the piston rod 308 is advanced, the die 120 is driven towards the roller 104, and when the piston rod 308 is retracted, the die 120 is driven away from the roller 104. The pin 316 comprises an eccentric feature for adjusting the shut height of the die 120. The lower (as seen in FIG. 21) end of the magazine 82 is lodged in a recess 318 in the roller support block 320 of the subframe portion 300. A sensor 322 is provided for determining the presence of a connector 2 in the recess 318 and is arranged to signal the control unit 84 if no magazine is present in the recess, to cause the apparatus to be placed in a no-start condition.

Figure 17:
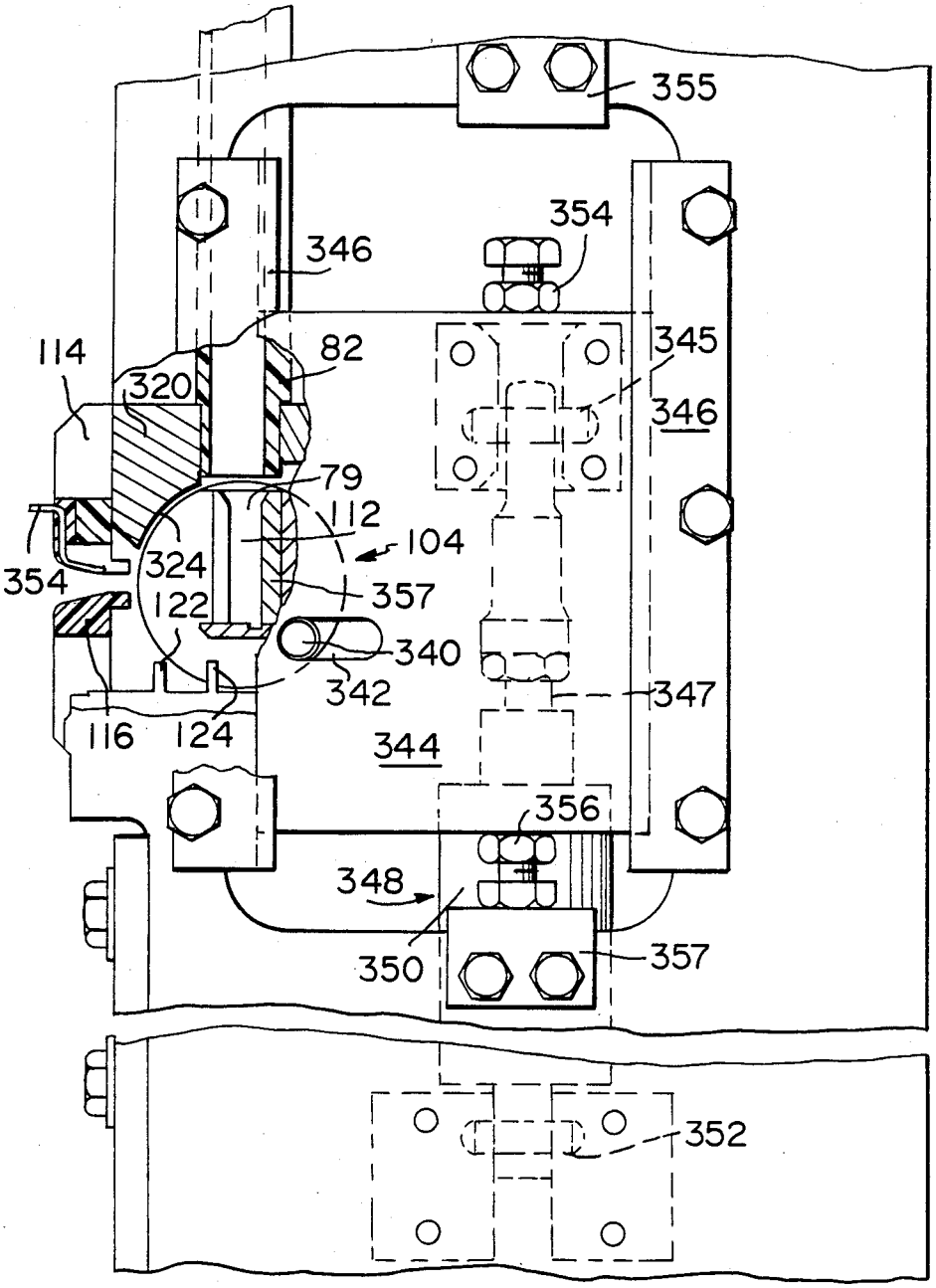
FIG. 17 is a fragmentary side view of a cable terminating assembly of the apparatus illustrating an anvil roller thereof positioned to receive an electrical connector.
Figure 18:
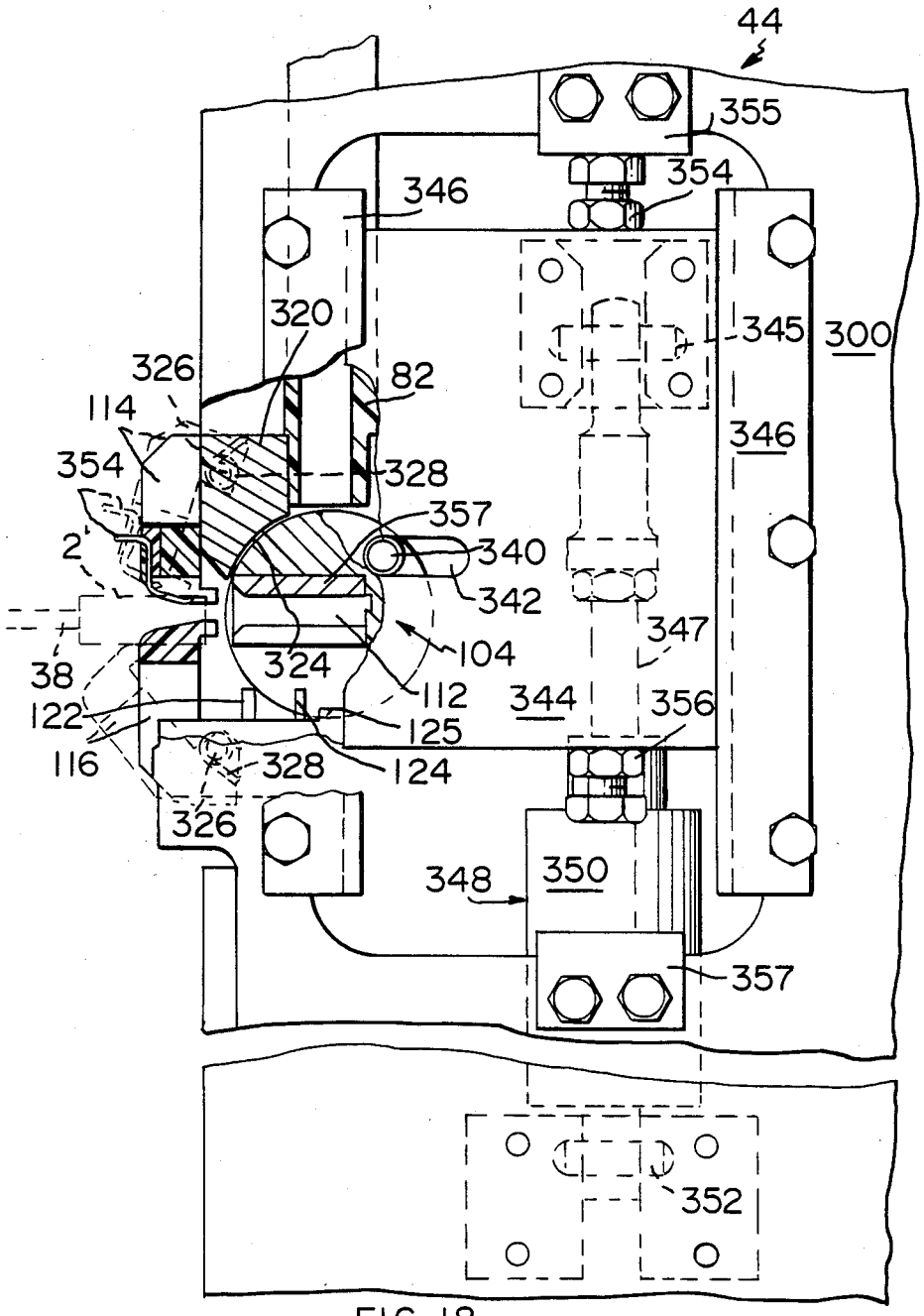
FIG. 18 is a similar view to that of FIG. 17 but showing the roller positioned for the termination of the cable to the connector.
Figure 19:
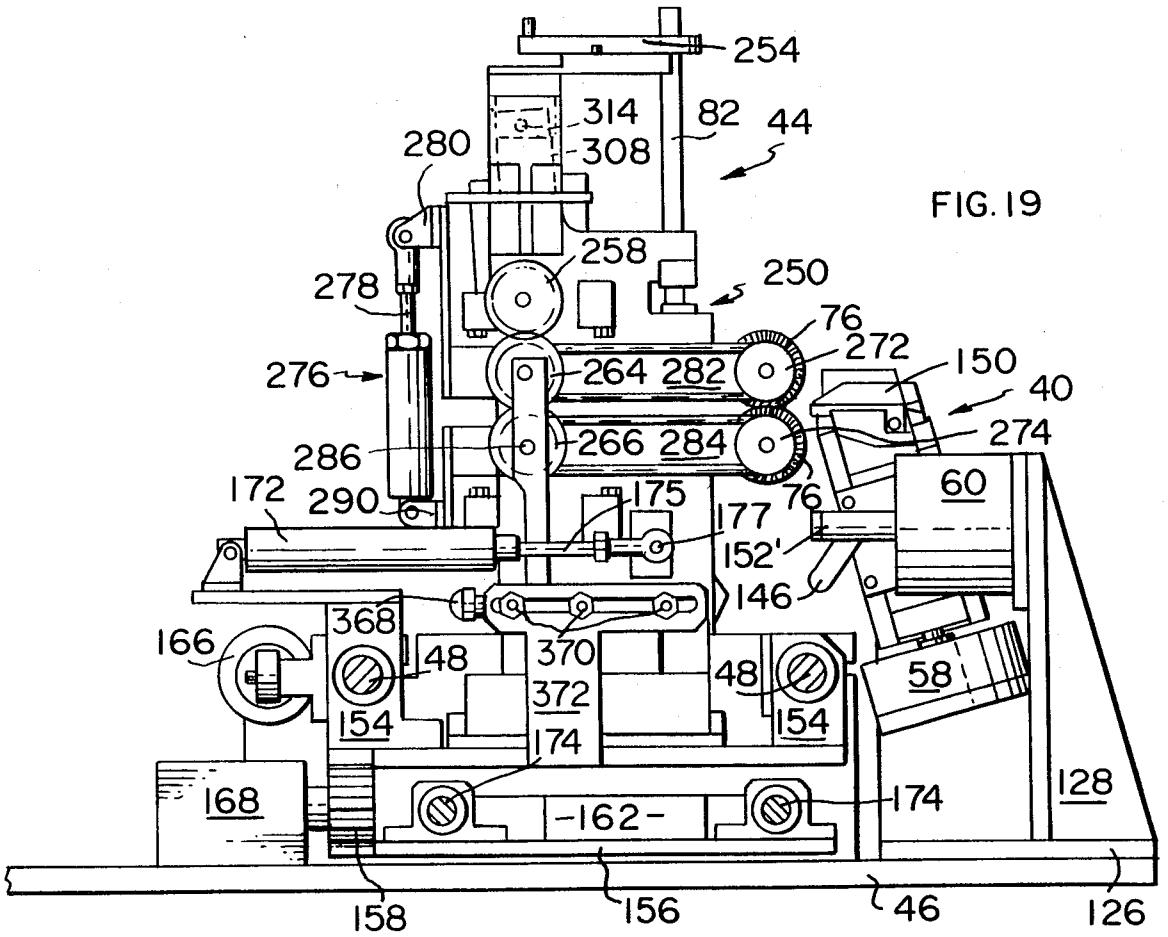
FIG. 19 is a view taken in the direction of the arrow 19 in FIG. 15.

The lips 114 and 116 are, as shown in FIG. 18, pivotally attached to the block 320 on pivot pins 326 to swing outwardly of the block 320 against the action of springs 238 to allow the connector 2' to which the cable 28 has been terminated to be withdrawn from the assembly 44, as indicated in broken lines in FIG. 18. A trunion 340, extending eccentrically from one end of the roller 104 (as best seen in FIG. 26A), is engaged in a horizontal slot 342 in a cam plate 344 which is slideable vertically between gibs 346 secured to the subframe portion 300. The piston rod 347 of a piston and cylinder unit 348, is pivotally attached to the plate 344 by means of a pin 345, the cylinder 350 of the unit 348 being pivotally attached to the subframe portion 300 by means of a pin 352. The vertical travel of the plate 344 is limited in the upward direction by an adjustable stop 354 thereon which co-operates with a stop plate 355 on the portion 300, and in the downward direction by an adjustable stop 356 on the plate 344, which co-operates with a stop plate 357 on the portion 300. When the piston rod 347 is in a fully retracted position, as shown in FIG. 17, the mouth 79 of the recess 112 of the roller 104 is in register with the magazine 82 to receive a connector therefrom, movement of the piston rod 347 to a fully advanced position, serving to rotate the roller 104 through 90 degrees to the angular position in which it is shown in FIG. 18, in which a connector in the recess 112 can receive the end of the cable 38 through the mouth 79 and can subsequently be crimped to the connector by means of the die 120. The lip 114 is provided with a sensor 354 for detecting the presence of the exposed cable shield 34, as the end of the cable 38 is inserted between the lips 114 and 116 and to signal the control unit 84 if the exposed shield 34 is not present, to cause the apparatus to be stopped. The roller 104 can be removed from the bore 324 by means of a knurled handle 355 at the opposite end thereof to the trunion 340.

Figure 26:
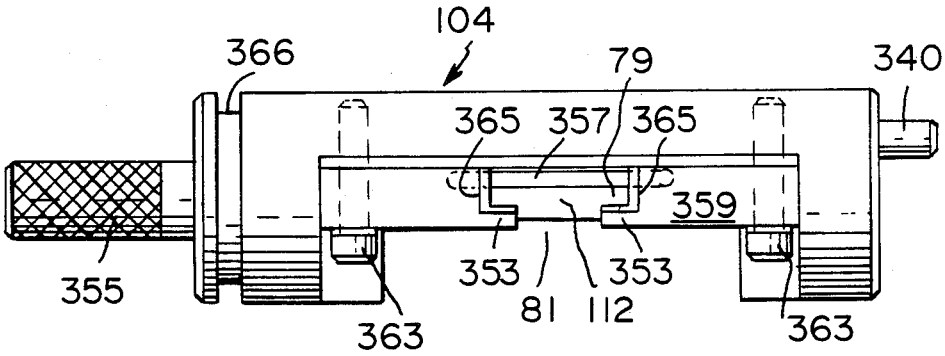
FIG. 26 is a frontal view of said roller.
Figure 26A:
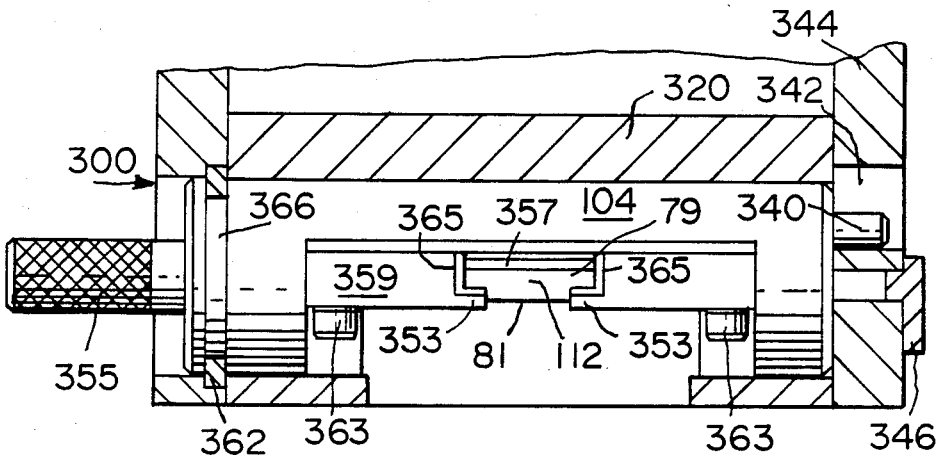
FIG. 26A is a view taken on the lines 26A—26A of FIG. 21.

As shown in FIGS. 26 and 26A, which show the roller 104 in its FIG. 18 position, the recess 112 has undercuts provided by flanges 353 and defining the mouth 81, to retain the connector 2' in the recess 112 but to allow the die 120 access to the lower surface of the connector 2'. The base of the recess 112 is formed with an anvil 357 facing the mouth 81, against which the connector 2' is urged by the crimping force applied to the die 120, as will be apparent from FIG. 21. The flanges 353 cooperate with sidewalls 365 of the recess 112 to guide the connector 2' thereinto. The recess 112 is provided in an anvil assembly insert 359 which is interchangeable and is mounted in a cut out 361 in the roller 104 by means of screws 363.

As shown in FIG. 22, a hold down plate 360 having a relieved free end 362 is loaded by a spring 364 to urge the end 362 against a neck 366 (best seen in FIG. 26) formed in the roller 104 adjacent to its handle 355. When the roller 104 is to be withdrawn from the bore 324, for exchange of the insert 359, a finger is inserted beneath a flange 368 (FIG. 22) on the plate 360 to raise it against the action of the spring 364.

The assembly 44 is provided with a buffer 368 (FIGS. 19 and 22) for engagement with the adjacent support 154, carrying the piston and cylinder unit 172, when the assembly 44 reaches its advanced position towards the assembly 40.

Sensors 370 (FIG. 15) which are adjustable lengthwise of a bracket 372 on the table 156, are provided for sensing the position of advance of the assembly 44, and for signalling the control unit 84 accordingly.

The various sensors described above, which feed sensing signals to the control unit 84, ensure, in cooperation therewith, that at all times, the apparatus is operable only when the travel of the parts concerned is correct, and the cable and connectors have been correctly supplied to the apparatus. Preferably, the control unit 84 is arranged to display an indication of any fault that may occur in these respects.

The insert 141, the roller 104, the jaws 66, the die 120, the slide 186 with the parts attached thereto and the magazine 82, are all exchangable to allow for cables having different numbers of conductors 32 to be terminated to connectors of appropriate size, for example, to allow for an 8-conductor cable to be terminated to an 8-way connector or for a 16-conductor cable to be terminated to a 16-way connector.

We claim:

1. Apparatus for assembling an electrical connector to an end portion of multi-conductor electrical cable having a cable sheath, the apparatus comprising:

a base;

a table on the base;

a cable clamp assembly on the base beside the table;

a cable sheath stripper assembly on the table;

a connector applicator assembly on the table beside the stripper assembly, for applying a connector to the end portion of the cable;

means for feeding connectors to said applicator assembly;

means for translating the table along the base in two opposite directions along a first path extending past the cable clamp assembly;

means for translating said stripper and applicator assemblies in two opposite directions and independently of one another, along respective second paths on said table, perpendicular to said first path;

drive means for said assemblies, said feed means and said translating means; and control means for so cycling said drive means that the end portion of a cable held by said clamp is stripped of the sheath by the stripper assembly, a connector fed to said applicator assembly by said feed means is moved onto the stripped end portion of the cable and said applicator assembly is actuated to apply that connector to said stripped end portion.

2. Apparatus as claimed in claim 1, wherein said stripper assembly comprises means for longitudinally slitting a metal shield surrounding the conductors of said cable to divide said shield into two flaps at said stripped cable end, means being provided on said table and between said stripper assembly and said applicator assembly, for moving said flaps apart from one another, and said applicator assembly being provided with means for folding said flaps back against the cable sheath prior to the application of said connector to said stripped cable end.

3. Apparatus as claimed in claim 2, wherein said slitting means comprise a pair of rolls each having a cutting blade, means for driving said rolls in rotation, means for moving said rolls between a position above said clamp assembly, and a position in alignment with said clamp assembly and between said clamp assembly and sheath stripping means of said stripping assembly, and means for guiding said rolls to receive said stripped cable end between them.

4. Apparatus as claimed in claim 2, wherein said means for moving said flaps apart from one another, comprises a nozzle secured to said table for projecting an air stream towards said cable clamp assembly, lips projecting from said nozzle for guiding said stripped cable end into alignment with said air stream projecting means, and stop surfaces on said lips for limiting the movement of said flaps apart from one another.

5. Apparatus as claimed in claim 2, wherein said folding back means comprise a pair of brushes, rotatably mounted on said applicator assembly, means for driving the brushes in opposite senses of rotation, and means for relatively moving the brushes between an open position, and a closed position about said cable end prior to the application of the connector thereto.

6. Apparatus as claimed in claim 1, wherein the cable clamp assembly is provided with a ram for ejecting the cable therefrom after the connector has been applied to the stripped cable end, and adjustment means for placing the cable clamp assembly in a first, partially open, cable end receiving position, a second fully closed, cable clamping position, and a third fully open position to allow the ram to eject the cable from the cable clamp assembly.

7. Apparatus as claimed in claim 6, wherein said adjustment means comprise, a piston and cylinder unit arranged to act upon a movable jaw of the clamp assembly to drive it between its second and third positions and cooperating means on the stripper assembly and the clamp assembly for placing the clamp assembly in its first position when the stripper assembly has been moved to a position proximate to the clamp assembly.

8. Apparatus as claimed in claim 1, wherein said connector feeding means comprises a connector magazine and a rotary anvil assembly having a connector receiving recess, said anvil assembly being mounted on said applicator assembly and beneath said magazine and means for rotating said anvil assembly between a first angular position to receive a connector from said magazine and a second angular position to receive said stripped cable end, a connector application die beneath said anvil assembly, and means for moving said die towards said anvil assembly to apply the connector to the cable end when the anvil assembly is in its second angular position, said recess having first and second mouths opening in respective orthogonal directions radially of said rotary anvil assembly and an anvil being provided in said recess, the anvil and the first mouth facing the die in the second position of said anvil assembly, said anvil assembly being mounted in a bore in the applicator assembly and said magazine communicating with said bore, so as to be in alignment with said second mouth in the first position of said anvil assembly.

9. An assembly as claimed in claim 1, wherein the table is slidable along rails secured to the base and between buffers on the base, the stripper assembly being mounted on a first slideway on the table and the applicator assembly being mounted on a second slideway on the table, the table being provided with a rack meshing with a pinion on the base, which pinion in turn meshes with a rack provided on a counter balance beneath the table to translate the counter balance in the opposite direction to the direction of translation of the table.

10. Apparatus for assembling an electrical connector to an end portion of a multi-conductor electrical cable having a metal shield surrounding the conductors thereof and an insulating sheath surrounding the shield, the apparatus comprising:

a base;

a table on the base;

a cable clamp first assembly mounted on the base beside the table;

a cable sheath stripping and cable shield slitting second assembly on the table;

a cable shield folding and cable terminating third assembly on the table beside said second assembly;

escapement means for feeding connectors from a magazine to said third assembly;

means for translating the table into two opposite directions along a first path extending past said first assembly;

means for translating said second and third assemblies in two opposite directions and independently of one another, along respective second paths on said table, extending perpendicularly to said first path;

drive means for said assemblies, said escapement means and said translating means; and control means for so cycling said drive means that the end portion of a cable held by said clamp is stripped of the sheath by said second assembly, said second assembly slits said shield at the stripped end portion of the cable, said third assembly folds back the shield from said stripped end portion against the cable sheath and a connector fed to said third assembly by said escapement means is moved onto said stripped end portion and is applied thereto by said third assembly.

* * * * *